US009116484B2

(12) United States Patent
Masumoto et al.

(10) Patent No.: US 9,116,484 B2
(45) Date of Patent: Aug. 25, 2015

(54) IMAGE FORMING APPARATUS, POWER CONTROL METHOD, AND RECORDING MEDIUM

(71) Applicant: Konica Minolta, Inc., Chiyoda-ku (JP)

(72) Inventors: Kosuke Masumoto, Toyokawa (JP); Mineo Yamamoto, Toyokawa (JP); Shiro Umeda, Toyokawa (JP); Shigeru Yamazaki, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/014,837

(22) Filed: Aug. 30, 2013

(65) Prior Publication Data

US 2014/0064774 A1 Mar. 6, 2014

(30) Foreign Application Priority Data

Sep. 3, 2012 (JP) ..... 2012-193616
Sep. 14, 2012 (JP) ..... 2012-203651

(51) Int. Cl.
*G03G 15/00* (2006.01)

(52) U.S. Cl.
CPC ..... *G03G 15/5004* (2013.01); *G03G 15/5016* (2013.01)

(58) Field of Classification Search
CPC ..... G03G 15/5004; H04N 1/00896; G06F 1/3231
USPC ..... 374/6; 702/135–136; 250/342; 399/88; 340/565
See application file for complete search history.

(56) References Cited

U.S. PATENT DOCUMENTS 5,822,077 A * 10/1998 Sasaki et al. ..... 358/296
5,877,688 A * 3/1999 Morinaka et al. ..... 340/584

(Continued)

FOREIGN PATENT DOCUMENTS

JP 61-013815 A 1/1986
JP 62-117574 U 7/1987

(Continued)

OTHER PUBLICATIONS

Boganov, S., "The Origin of the Piezoelectric Effect in Pyroelectric Crystals", IEEE Transactions on Ultrasonics, Ferroelectrics, and Frequency Control, vol. 49, No. 11, Nov. 2002.*

(Continued)

*Primary Examiner* — David Gray
*Assistant Examiner* — Sevan A Aydin
(74) *Attorney, Agent, or Firm* — Buchanan Ingersoll & Rooney PC

(57) ABSTRACT

An image forming apparatus comprises: a piezoelectric sensor that produces an variable output signal depending on the amount of infrared energy; a human body detecting device having a lens that forms a detecting area serving for detecting if the person enters; a peak detector that detects a peak of an output signal produced when the person enters the detecting area; an offset voltage judgment portion that judges if the output signal falls to the offset voltage after the peak; a moving direction judgment portion that judges the direction in which the person moves in the detecting area; and a mode controller that switches the power supply mode to a first mode if the power supply mode is found to be a second mode requiring less power than the first mode while the moving direction judgment portion judges that the person moves toward the image forming apparatus.

25 Claims, 16 Drawing Sheets

(56) References Cited

U.S. PATENT DOCUMENTS

| | | | | |
|---|---|---|---|---|
| 8,629,998 | B2 * | 1/2014 | Honda et al. | 358/1.14 |
| 8,823,967 | B2 * | 9/2014 | Mamiya et al. | 358/1.14 |
| 2002/0054330 | A1 * | 5/2002 | Jinbo et al. | 358/1.15 |
| 2002/0089694 | A1 * | 7/2002 | Idehara | 358/1.15 |
| 2004/0135688 | A1 * | 7/2004 | Zhevelev et al. | 340/565 |
| 2010/0150600 | A1 * | 6/2010 | Oyoshi | 399/88 |
| 2010/0231390 | A1 * | 9/2010 | Hashimoto | 340/573.1 |
| 2012/0127518 | A1 * | 5/2012 | Ogata et al. | 358/1.15 |
| 2012/0137154 | A1 * | 5/2012 | Azuma et al. | 713/323 |
| 2012/0204046 | A1 * | 8/2012 | Baba et al. | 713/323 |
| 2012/0292510 | A1 * | 11/2012 | Tanaka et al. | 250/338.3 |
| 2012/0296602 | A1 * | 11/2012 | Oyoshi | 702/150 |
| 2012/0326038 | A1 * | 12/2012 | Yamashina et al. | 250/338.3 |
| 2012/0327458 | A1 * | 12/2012 | Baba et al. | 358/1.15 |
| 2012/0328319 | A1 * | 12/2012 | Ogata et al. | 399/75 |
| 2013/0010335 | A1 * | 1/2013 | Baba et al. | 358/3.01 |
| 2013/0057894 | A1 * | 3/2013 | Narushima et al. | 358/1.14 |
| 2013/0073887 | A1 * | 3/2013 | Miki et al. | 713/323 |
| 2013/0120779 | A1 * | 5/2013 | Baba et al. | 358/1.13 |
| 2013/0128298 | A1 * | 5/2013 | Yamada | 358/1.13 |
| 2013/0219198 | A1 * | 8/2013 | Kuroishi et al. | 713/310 |
| 2013/0250372 | A1 * | 9/2013 | Ogata et al. | 358/442 |
| 2013/0258424 | A1 * | 10/2013 | Ono et al. | 358/475 |
| 2013/0300198 | A1 * | 11/2013 | Yamashina et al. | 307/39 |
| 2014/0029037 | A1 * | 1/2014 | Oyoshi | 358/1.13 |
| 2014/0092417 | A1 * | 4/2014 | Kuroishi et al. | 358/1.14 |
| 2014/0140716 | A1 * | 5/2014 | Ogata et al. | 399/81 |

FOREIGN PATENT DOCUMENTS

| | | | |
|---|---|---|---|
| JP | 05-203762 | A | 8/1993 |
| JP | 06-043025 | A | 2/1994 |
| JP | 06-242226 | A | 9/1994 |
| JP | 08-096968 | A | 4/1996 |
| JP | 10-160856 | A | 6/1998 |
| JP | 2000-132755 | A | 5/2000 |
| JP | 2000-163662 | A | 6/2000 |
| JP | 2002-006686 | A | 1/2002 |
| JP | 2007-178204 | A | 7/2007 |

OTHER PUBLICATIONS

Machine transaltion of Asakura, H06-242226 (1994).*

Office Action (Notification of Reasons for Refusal) issued on Oct. 14, 2014, by the Japanese Patent Office in corresponding Japanese Patent Application No. 2012-193616 and an English translation of the Office Action. (6 pages).

Office Action (Notification of Reasons for Refusal) issued on Nov. 12, 2014, by the Japanese Patent Office in corresponding Japanese Patent Application No. 2012-203651 and an English translation of the Office Action. (5 pages).

* cited by examiner

IMAGE FORMING APPARATUS, POWER CONTROL METHOD, AND RECORDING MEDIUM

This application claims priority under 35 U.S.C. §119 to Japanese Patent Applications No. 2012-193616 filed on Sep. 3, 2012 and No. 2012-203651 filed on Sep. 14, 2012, the entire disclosures of both of which are incorporated herein by reference in their entirety.

BACKGROUND OF THE INVENTION

1. Field of the Invention

The present invention relates to: an image forming apparatus that is capable of detecting movement of a human body to the image forming apparatus itself and changing its power supply mode on the basis of the results of its detection; a power control method to be implemented by the image forming apparatus; a recording medium storing a power control program for making a computer of the image forming apparatus implement the power control method.

2. Description of the Related Art

The following description sets forth the inventor's knowledge of related art and problems therein and should not be construed as an admission of knowledge in the prior art.

Some copiers, printers, facsimiles, and image forming apparatuses such as multifunctional digital machines that are referred to as multi-function peripherals (MFP) having copier, printer, and facsimile function, for example, are provided with a human body detecting device that detects if a person moves toward the human body detecting device itself, in order to return to normal operation mode from power saving mode and start warm-up operation.

As an example of such a human body detecting device, there has been known a human body detecting device having a piezoelectric sensor (also referred to as piezoelectric infrared sensor) that is capable of detecting a human body with less power consumption at low costs. Such a piezoelectric sensor detects a temperature change when a person moves in a detection range of the piezoelectric sensor itself.

As an example of such a human body detecting device having a piezoelectric sensor, Japanese Unexamined Patent Publication No. H06-043025 discloses a human body detecting device having a single piezoelectric sensor and a concentrator each of whose sectional detecting areas consists of different sizes of effective detecting areas. As for this human body detecting device, when a human body moves through a plurality of effective detecting areas, the piezoelectric sensor detects far infrared energy emitted by the human body and produces different output frequencies depending on the effective detecting area. The difference in the duration or the output frequency allows the human body detecting device to identify the detecting area entered by the human body.

This piezoelectric sensor detects a temperature change when a person enters a detection range of the piezoelectric sensor itself. Being installed on an image forming apparatus such as that mentioned previously, the piezoelectric sensor has difficulties in detecting a temperature change which is too small in this case: in the image forming apparatus, the piezoelectric sensor is usually directed against the direction in which a person (user) moves toward the piezoelectric sensor itself with an intention to operate the image forming apparatus. Therefore the image forming apparatus hardly identifies the direction in which a person moves toward the image forming apparatus itself or the position at which he/she pauses.

The image forming apparatus possibly may detect that a person pauses just in front of itself but hardly judges whether or not this person has an intention to operate the image forming apparatus. In order to judge whether or not he/she has an intention to operate the image forming apparatus, the image forming apparatus needs to detect whether or not any button is pressed on its operation panel or needs to detect, with an electrostatic sensor installed on its operation panel, whether or not user's hand is close to the operation panel.

Japanese Unexamined Patent Publication No. 2000-132755 discloses a technique of avoiding errors caused by unnecessary heat rays incoming in certain directions by putting a lens block (light-proof chip) in a sensor container case.

(First Object)

The human body detecting device described in Japanese Unexamined Patent Publication No. H06-043025 identifies the detecting area entered by a person but hardly identifies the direction in which this person moves unless he/she enters more than one detecting area. More specifically, if an image forming apparatus is provided with the human body detecting device described in Japanese Unexamined Patent Publication No. H06-043025, a user possibly reaches the image forming apparatus, before the human body detecting device identifies the direction in which he/she moves, only to find that he/she has to wait so long until the image forming apparatus becomes ready for operation, i.e.; until the image forming apparatus successfully returns to normal operation mode from power saving mode.

It is a first object of the present invention to provide: an image forming apparatus that is capable of decreasing user wait time before it becomes ready for operation, by judging in an early stage if a person moves toward the image forming apparatus itself; a power control method for the image forming apparatus; and a recording medium storing a power control program for making a computer of the image forming apparatus implement the power control method.

(Second Object)

In order to judge whether or not a user has an intention to operate the image forming apparatus, the image forming apparatus needs to detect whether or not any button is pressed on its operation panel or needs to detect, with an electrostatic sensor installed on its operation panel, whether or not user's hand is close to the operation panel.

More specifically, if the image forming apparatus is capable of reducing power consumption by entering power saving mode when not in use and returning to normal operation mode when there is a user with an intention to operate the image forming apparatus itself, the image forming apparatus returns to normal operation mode only if detecting that any button is pressed on its operation panel or only if detecting, with an electrostatic sensor installed on its operation panel, that user's hand is close to the operation panel. In this case, the user possibly reaches the image forming apparatus only to find that he/she has to wait so long until it becomes ready for operation, which is very troublesome.

On the basis of the technique disclosed in Japanese Unexamined Patent Publication No. 2000-132755, an image forming apparatus has achieved in avoiding errors caused by unnecessary heat rays incoming in certain directions but still has not solved the problem mentioned above.

It is a second object of the present invention to provide: an image forming apparatus that is capable of decreasing user wait time before it becomes ready for operation, by judging in an early stage if a user has an intention to operate the image forming apparatus itself; a power control method for the image forming apparatus; and a recording medium storing a power control program for making a computer of the image forming apparatus implement the power control method.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

A first aspect of the present invention relates to an image forming apparatus comprising:

a piezoelectric human body sensor being configured to produce a variable output signal having a voltage waveform with a positive or negative peak based on a certain level of offset voltage, depending on the amount of infrared energy emitted by a person;

a human body detecting device having the human body sensor and a lens being positioned to cover the human body sensor, the lens being configured to form a detecting area serving for detecting if the person enters, the detecting area extending outside of the human body detecting device itself in front of the image forming apparatus;

a peak detector being configured to detect a peak of an output signal produced by the human body sensor when the person enters the detecting area;

an offset voltage judgment portion being configured to judge if the output signal falls to the offset voltage after the peak detected by the peak detector;

a moving direction judgment portion being configured to judge the direction in which the person moves in the detecting area, on the basis of the peak value of the peak detected by the peak detector and the judgment result obtained by the offset voltage judgment portion; and a mode controller being capable of switching a power supply mode for controlling power supply to each portion of the image forming apparatus, between a first operation mode and a second operation mode requiring less power than the first operation mode, the mode controller being configured to switch the power supply mode to the first operation mode if the power supply mode is found to be the second operation mode while the moving direction judgment portion judges that the person moves toward the image forming apparatus.

A second aspect of the present invention relates to an image forming apparatus comprising:

a piezoelectric human body sensor being configured to produce a variable output signal depending on the amount of infrared energy emitted by a user;

a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas;

a non-detecting time detector being configured to detect a non-detecting time if the human body sensor produces a low level of output signal corresponding to the presence of the non-detecting area after an output signal corresponding to the presence of the first detecting area;

an entry judgment portion being configured to judge if the user, who is in the first detecting area, enters the second detecting area by moving a part of the user's body forward over the non-detecting area, on the basis of either one of both of the magnitude and the frequency of an output signal produced after the non-detecting time; and a power controller being capable of switching a power supply mode for controlling power supply to each portion of the image forming apparatus, between a first operation mode and a second operation mode requiring less power than the first operation mode, the power controller being configured to switch the power supply mode to the first operation mode, if the power supply mode is found to be the second operation mode while the entry judgment portion judges that the user enters the second detecting area by moving a part of the user's body.

A third aspect of the present invention relates to a power control method to be implemented by an image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control method comprising:

detecting a peak of an output signal produced by the human body sensor when the person enters the detecting area;

judging if the output signal falls to the offset voltage after the peak detected by the peak detector; and judging the direction in which the person moves in the detecting area, on the basis of the peak value of the peak and the result of the judgment on the output signal, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the person moves toward the image forming apparatus.

A fourth aspect of the present invention relates to a power control method to be implemented by an image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the person gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control method comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the user enters the second detecting area by moving a part of the user's body.

A fifth aspect of the present invention relates to a non-transitory computer-readable recording medium storing a power control program for making a computer of an image forming apparatus execute processing, the image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control program comprising:

detecting a peak of an output signal produced by the human body sensor when the person enters the detecting area;

judging if the output signal falls to the offset voltage after the peak; and judging the direction in which the person moves in the detecting area, on the basis of the peak value of the peak and the result of the judgment on the offset voltage, wherein a power supply mode for controlling power supply to each portion of the image forming apparatus can be switched between a first operation mode and a second operation mode requiring less power than the first operation mode, the power control program further comprising switching the power supply mode to the first operation mode if the power supply mode is found to be the second operation mode while it is judged that the person moves toward the image forming apparatus.

A sixth aspect of the present invention relates to a non-transitory computer-readable recording medium storing a power control program for making a computer of an image forming apparatus execute processing, the image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control program comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each of the image forming apparatus can be switched between a first operation mode and a second operation mode requiring less power than the first operation mode, the power control program further comprising switching the power supply mode to the first operation mode if the power supply mode is found to be the second operation mode while it is judged that the user enters the second detecting area by moving a part of the user's body.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

First Embodiment

Hereinafter, one embodiment of the present invention will be described in combination with the accompanying drawings.

Figure 1:
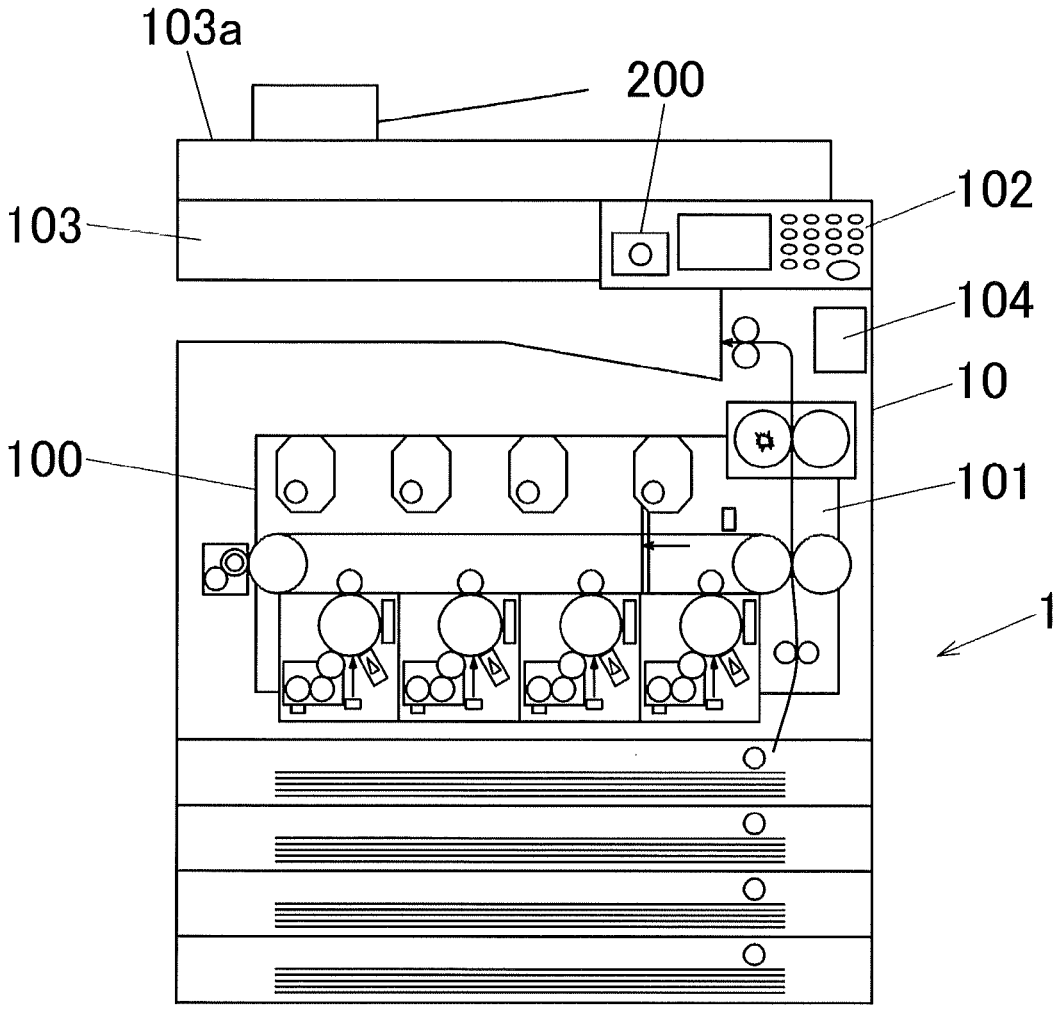
FIG. 1 is a schematic view illustrating a structure of an image forming apparatus according to a first embodiment of the present invention.
Figure 2:
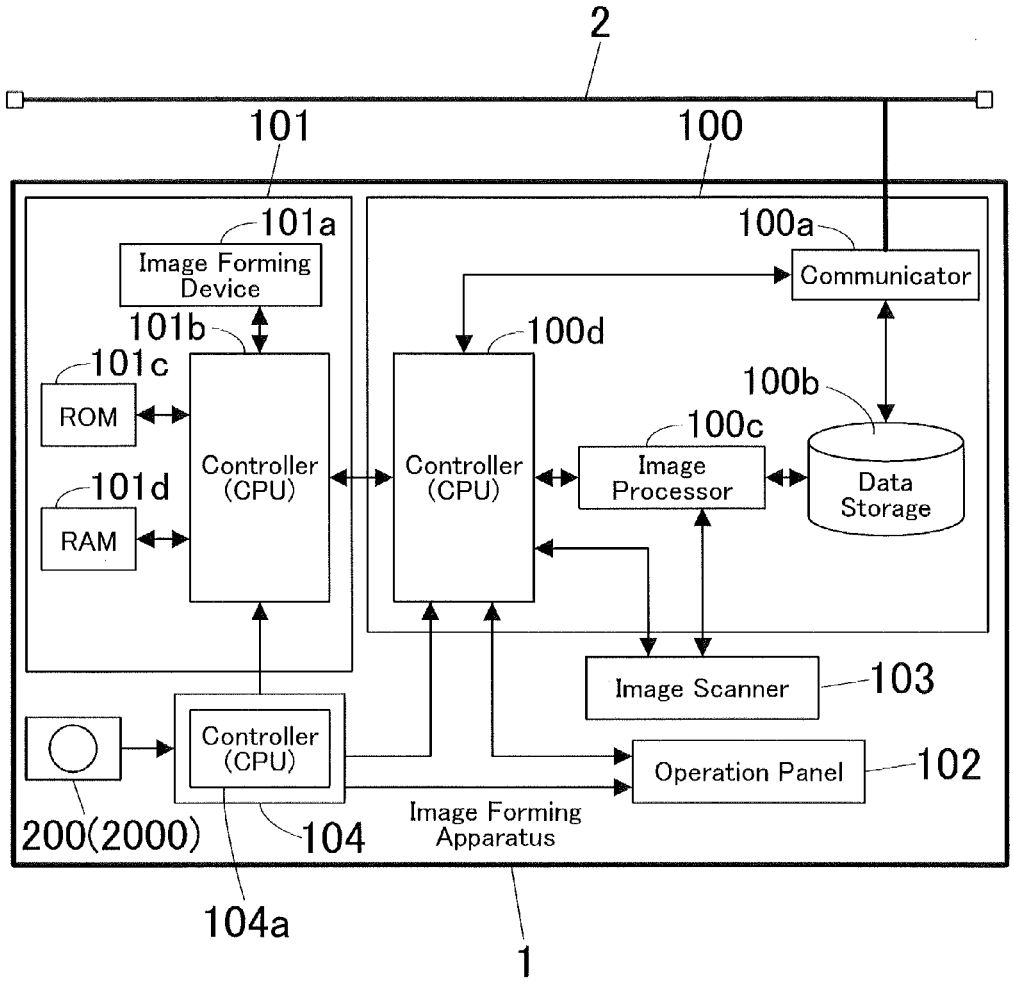
FIG. 2 is a block diagram illustrating an electrical configuration of the same.

FIG. 1 is a schematic view illustrating a structure of an image forming apparatus 1 according to a first embodiment of the present invention; FIG. 2 is a block diagram illustrating en electrical configuration of the same.

As illustrated in FIGS. 1 and 2, the image forming apparatus 1 is provided with: an image processor block 100; an engine controller block 101; an operation panel 102; an image scanner 103; a power controller block 104; and a human body detecting device 200.

The image processor block 100 performs processing on images received from a network 2 or obtained by the image scanner 103. The image processor block 100 is provided with: a communicator 100*a* that serves for data communication with the network 2; a data storage 101*b* such as a hard disk drive, storing images received and other data; an image processor 100*c* that performs certain processing on images received; and a controller (CPU) 100*d*. The controller 100*d* controls each portion of the image processor block 100, the image scanner 103, and the operation panel 102 by cooperatively working with a controller (CPU) 101*b* of the engine controller block 101 and a controller (CPU) 104*a* of the power controller block 104.

The engine controller block 101 is provided with: an image forming device 101*a*; the controller (CPU) 101*b*; a ROM 101*c*; and a RAM 101*d*.

The image forming device 101*a* is a structure member for printing images on paper. The image forming device 101*a* is composed of: a photoreceptor drum; a development unit; a charged unit; a transfer belt; a toner cartridge; a paper feeder/conveyer; a fuser; and the like, all of which are not shown in the figure.

The controller 101*b* controls the image forming device 101*a* by cooperatively working with the controller 100*d* of the image processor block 100 and the controller 104*a* of the power controller block 104; the ROM 101*c* stores operation programs for the CPU of the controller 101*b* to perform processing; the RAM 101*d* shares its work area for the CPU of the controller 101*b* to perform processing.

The operation panel 102 allows user to configure the settings of various functions before using the image forming apparatus 1 and displays operation screens, the state of the image forming apparatus 1, messages, and the like. The operation panel 102 is installed on the top edge of the front side of the image forming apparatus or at a position near the top edge thereof.

The image scanner 103 obtains a digital image by scanning a physical document. In this embodiment, the image forming apparatus 1 has an automatic document feeder (ADF) 103*a* that transfers a physical document to a scanning position, on the top surface of its main body 10.

The power controller block 104 is provided with a power supply device that converts commercial AC power to DC, which is not shown in the figure, and the controller (CPU) 104*a*. The controller 104*a* provides power to each portion of the image forming apparatus 1 while controlling the amount of power depending on the load applied to the image forming apparatus 1. Specifically, in this embodiment, the controller 104*a* receives an output signal of a human body sensor of the human body detecting device 200 through an amplifier not shown in the figure, selects among multiple power supply modes by analyzing the output signal, and controls power supply to each portion of the image forming apparatus 1 by the selected mode.

As illustrated in FIG. 3, the human body detecting device 200 is provided with: a human body sensor 202 being positioned on a board not shown in the figure; and a condenser lens 203 that is a Fresnel lens, being attached to the board such that it covers the human body sensor 202.

The human body sensor 202 is comprised of a piezoelectric sensor that produces a different output depending on the amount of incoming infrared energy. In this embodiment, the human body sensor 202 is a sensor that is capable of being either positively or negatively charged; however, it should be understood that the human body sensor 202 is in no way limited to either one of the two types.

The condenser lens 203 forms one human body detecting space 205 serving to detect infrared energy emitted by a human body as a heat source. The human body detecting space 205 is a light distribution area of the condenser lens 203.

When a person (heat source) passes through the human body detecting space 205, the human body sensor 202 that is a piezoelectric infrared sensor produces a piezoelectric effect as described below with reference to FIG. 3.

Figure 3A:
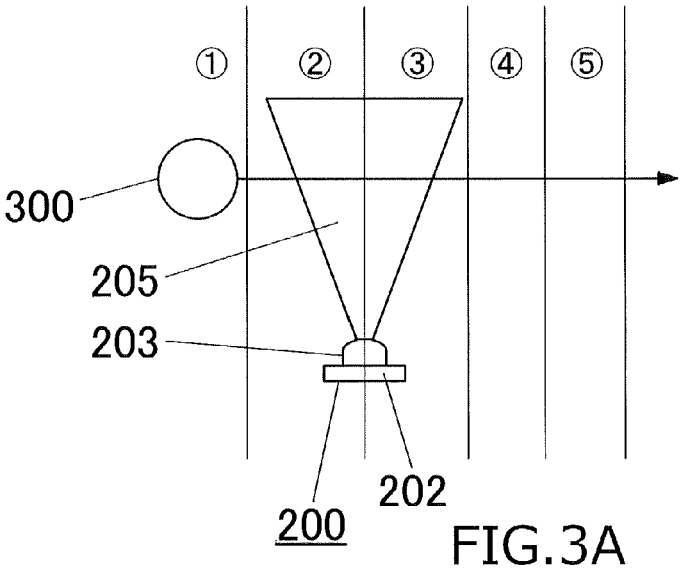
FIG. 3A illustrates how a human body (heat source) passes through a detecting space in a direction indicated by an arrow.
Figure 3B:
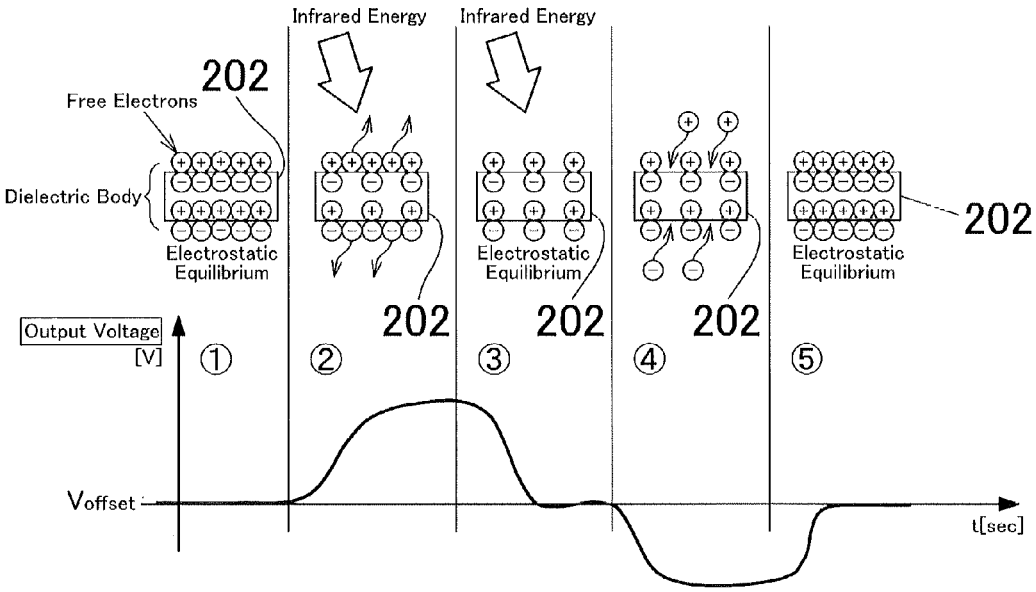
FIG. 3B illustrates charge distributions on the surface of a human body sensor and a waveform of output signals of the human body sensor when a person passes through a detecting space.

FIG. 3A illustrates how a human body (heat source) 300 passes through the detecting space 205 in a direction indicated by an arrow; FIG. 3B illustrates charge distributions on the surface of the human body sensor 202 and a waveform of output signals of the human body sensor 202 when a person 300 passes through the detecting space 205.

Before the human body (heat source) 300 enters the detecting space 205 (in the stage indicated by number 1 of FIG. 3A), the human body sensor 202 achieves electrostatic equilibrium with free electrons on its dielectric body and outputs an offset voltage Voffset (in the stage indicated by number 1 of FIG. 3B).

When the human body 300 enters the detecting space 205 (in the stage indicated by number 2 of FIG. 3A), the human body sensor 202 starts losing free electrons from its dielectric body by infrared energy emitted by the human body 300 and changes its output voltage (in the stage indicated by number 2 of FIG. 3B). Not being able to lose any more free electrons, the human body sensor 202 recovers electrostatic equilibrium and again outputs the offset voltage Voffset (in the stage indicated by number 3 of FIGS. 3A and 3B). When the human body 300 passes through the detecting space 205 (in the stage indicated by number 4 of FIG. 3A), the human body sensor 202 starts retrieving free electrons in order to recover electrostatic equilibrium and decreases its output voltage to lower than the offset voltage Voffset (in the stage indicated by number 4 of FIG. 3B).

After that, the human body sensor 202 recovers electrostatic equilibrium with free electrons on its dielectric body and again outputs the offset voltage Voffset (in the stage indicated by number 5 of FIGS. 3A and 3B).

As described above, when the human body 300 passes through the detecting space 205, the human body sensor 202 produces an output signal having a waveform with a positive and negative peak based on the offset voltage Voffset then produces an output signal having the offset voltage Voffset, depending on the amount of infrared energy incoming through the condenser lens 203. Here, it should be noted that the human body sensor 202 produces an output signal having a reverse waveform depending on whether it is positive or negative. In this embodiment, a positive peak comes prior to a negative peak in the waveform, for example.

Figure 4A:
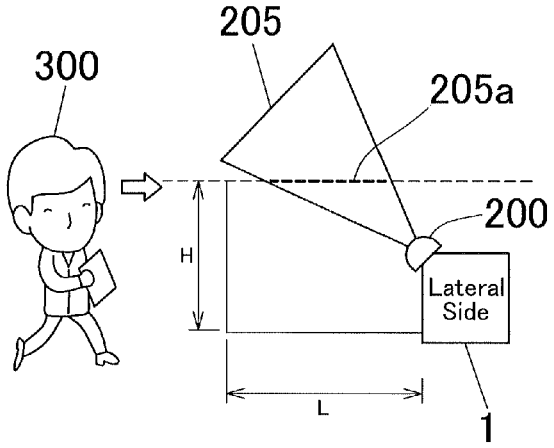
FIG. 4A is a schematic view illustrating the image forming apparatus laterally for a better understanding of the direction and the detecting area of a human body detecting device.

Furthermore, in this embodiment, the human body detecting device 200, having such a configuration as described above, is installed at a position near the operation panel 102 of the main body 10 of the image forming apparatus 1 such that the center of the human body detecting device 200 is directed obliquely upward as illustrated in FIG. 4A. As illustrated in FIG. 4A, the human body detecting device 200, having the human body sensor 202 and the condenser lens 203, forms one human body detecting space 205 serving to detect infrared energy emitted by a human body as a heat source, just in front of the image forming apparatus 1 (between a user and the image forming apparatus 1). The human body detecting space 205 is a light distribution area of the condenser lens 203, radially extending outside of the human body detecting device 200.

Figure 4B:
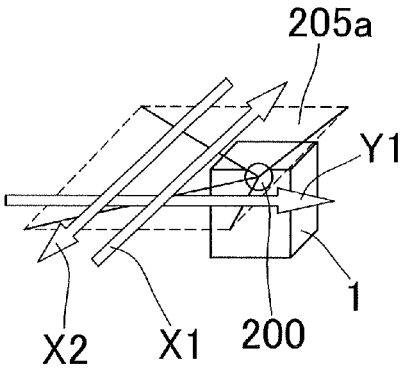
FIG. 4B is a schematic view illustrating the image forming apparatus squarely and obliquely downward from top for a better understanding of the detecting area of the human body detecting device.

FIG. 4B illustrates a horizontal plane representing these conditions including the human body detecting space 205, along with a person who may move as indicated by arrows. Specifically, in the horizontal plane, there is a detecting area 205*a* just in front of the image forming apparatus 1 (between this person and the image forming apparatus 1).

This detecting area 205*a* serves to detect the direction in which a person moves. Specifically, in this embodiment, the detecting area 205*a* is allowed to detect heat energy from the face of a person of 170 centimeters in height who moves toward the image forming apparatus 1 at a speed of 4.8 kilometers per hour, when he/she reaches in an office a position L that is 2.5 meters away from the image forming apparatus 1, only two more seconds before the image forming apparatus 1. The detecting area 205*a* has a size of more than one meter square so as to cover the stride length of a person of average body size.

Only one detecting area 205*a* in front of and near the image forming apparatus 1 is enough to accomplish this configuration. Alternatively, the condenser lens 203 may be a fly-eye lens consisting of a plurality of single lenses such that a plurality of detecting areas are formed by the respective single lenses in front and back of and/or to the right and left of the detecting area 205*a*.

Figure 5:
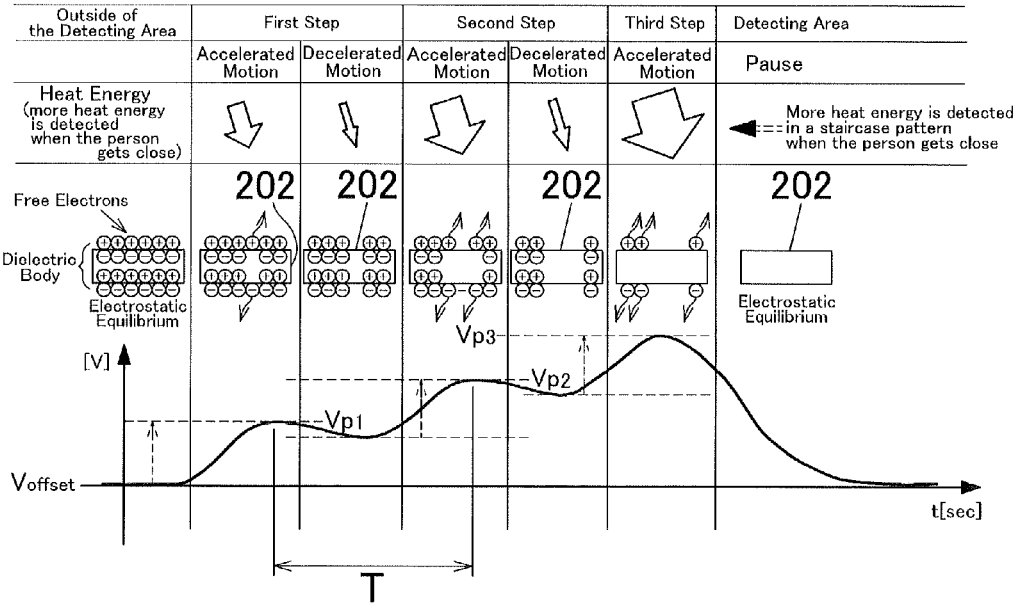
FIG. 5 illustrates charge distributions on the surface of the human body sensor and a waveform of output signals of the human body sensor when a person moves toward the image forming apparatus.

FIG. 5 illustrates charge distributions on the surface of the human body sensor 202 and a waveform of output signals of the human body sensor 202 when a person moves toward the image forming apparatus 1 as indicated by arrow X1 in FIG. 4B.

A person usually walks while repeating acceleration and deceleration on a periodic basis, the human body sensor 202 therefore produces an output signal which is characteristic for its waveform as to be described below.

When a person takes a first step to enter the detecting area 205*a* from the outside, the output voltage raises because of his/her accelerated motion. When the person prepares to take a second step, the output voltage never falls until the offset voltage Voffset but only slightly falls, because of his/her decelerated motion. As a result, the waveform shows a positive peak Vp1.

And then when the person further takes a second step, the output voltage again raises because of his/her accelerated motion. The human body sensor 202 detects more heat energy depending on the phase as the person moves toward the human body sensor 202 itself. As a result, the output voltage rises over the positive peak Vp1 due to the accelerated motion of the first step. Similarly, when the person prepares to take a third step, the output voltage never falls until the offset voltage Voffset but only slightly falls, because of his/her decelerated motion. As a result, the waveform shows a positive peak Vp2 whose peak value is greater than that of the positive peak Vp1 due to the accelerated motion of the first step. The size of arrows in the table of FIG. 5 represents the amount of heat energy.

The person repeats acceleration and deceleration as described above until reaching the image forming apparatus 1. When the person reaches the image forming apparatus 1, the waveform will result in showing multiple positive peaks Vp1, Vp2, Vp3 . . . whose peak values are greater in this order. Furthermore, the output voltage rises approximately in a staircase pattern on the basis of the characteristic motions of the walking person, without falling until the offset voltage Voffset between these positive peaks. Only by analyzing this waveform of output signals as described above, the controller (CPU) 104*a* of the power controller block 104 judges that a person moves toward the image forming apparatus 1 (to operate the operation panel 102).

Specifically, the controller 104*a* of the power controller block 104 detects the positive peaks Vp1, Vp2, Vp3 . . . in the waveform. Taking the last two peaks (for example, the positive peaks Vp1 and Vp2) as reference values, the controller 104*a* of the power controller block 104 judges whether or not the peak value of the second positive peak Vp2 is greater than that of the first positive peak Vp1 and whether or not the waveform has a drop to the offset voltage Voffset between the first and second positive peak Vp1 and Vp2. If the peak value of the second positive peak Vp2 is greater than that of the first positive peak Vp1 and the waveform does not have a drop to the offset voltage Voffset between the first and second positive peak Vp1 and Vp2, the controller 104*a* of the power controller block 104 then judges that a person moves toward the image forming apparatus 1.

Before detecting that a person moves toward the image forming apparatus 1, the controller 104*a* sets the power supply mode of the image forming apparatus 1 to power saving mode in order to cut off power supply to any of the image processor block 100, the engine controller block 101, and the operation panel 102. When detecting that a person moves toward the image processing apparatus 1, the controller 104*a* of the power controller block 104 switches the power supply mode from power saving mode to that for normal operation (normal operation mode) because he/she seems likely to have an intention to operate the image processing apparatus 1.

In comparison to the conventional technique of detecting the direction in which a person moves through a plurality of detecting areas, the image forming apparatus 1 decreases user wait time before it becomes ready for operation, by judging in an early stage which power supply mode should be selected.

It should be understood that, when a person moves toward the image forming apparatus 1, the image forming apparatus 1 sometimes may be already in normal operation mode shortly after the last operation or for another reason. In this case, as a matter of course, the controller 104*a* will keep that mode.

Alternatively, the controller 104*a* of the power controller block 104 may be capable of switching the image forming apparatus 1 between the following power supply modes: power saving mode, normal operation mode, and sub-level power saving mode requiring less power than normal operation mode but more power than power saving mode. In this case, the period T between the first positive peak Vp1 and the second positive peak Vp2 is compared to a predetermined value (for example, one second); if it is greater than the predetermined value, i.e.; if a person moves toward the image forming apparatus 1 at a regular walking speed or slowly, the image forming apparatus 1 may switch its power supply mode from power saving mode to sub-level power saving mode, then from sub-level power saving mode to normal operation mode, in a step-by-step manner with the lapse of time.

In sub-level power saving mode, the image processing apparatus 1 restores power supply to the image processor block 100, for example. That is because it takes long for the controller (CPU) 100*d* of the image processor block 100 to return to normal.

Figure 6:
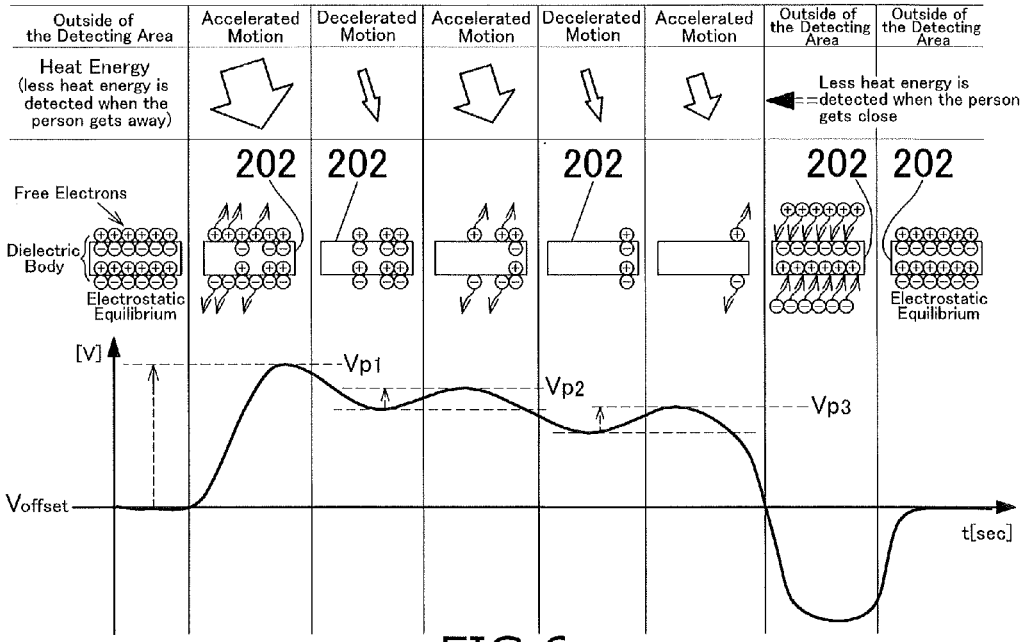
FIG. 6 illustrates charge distributions on the surface of the human body sensor and a waveform of output signals of the human body sensor when a person, who entered the detecting area, moves away from the image forming apparatus.

FIG. 6 illustrates charge distributions on the surface of the human body sensor 202 and a waveform of output signals of the human body sensor 202 when a person, who is in the detecting area 205*a*, moves away from the image forming apparatus 1 as indicated by arrow X2 in FIG. 4B.

When a person takes a first step to move away from the image forming apparatus 1, the output voltage raises because of his/her accelerated motion. When the person prepares to take a second step, the output voltage never falls until the offset voltage Voffset but only slightly falls, because of his/her decelerated motion. As a result, the waveform shows a positive peak Vp1.

And then when the person further takes a second step, the output voltage again raises because of his/her accelerated motion. The human body sensor 202 detects less heat energy depending on the phase as the person moves away from the human body sensor 202 itself. As a result, the output voltage falls below the positive peak Vp1 due to the accelerated motion of the first step. Similarly, when the person prepares to take a third step, the output voltage never falls until the offset voltage Voffset but only slightly falls, because of his/her decelerated motion. As a result, the waveform shows a positive peak Vp2 whose peak value is lower than that of the positive peak Vp1 due to the accelerated motion of the first step.

The person repeats acceleration and deceleration as described above until he/she stops moving away from the image forming apparatus 1. When the person stops moving away from the image forming apparatus 1, the waveform will result in showing multiple positive peaks Vp1, Vp2, Vp3 . . . whose peak values are lower in this order. Furthermore, the output voltage falls approximately in a staircase pattern on the basis of the characteristic motions of the walking person, without falling until the offset voltage Voffset between these positive peaks. Only by analyzing this waveform of output signals as described above, the controller (CPU) 104*a* of the power controller block 104 judges that a person moves away from the image forming apparatus 1.

Specifically, the controller 104*a* of the power controller block 104 detects the positive peaks Vp1, Vp2, Vp3 . . . in the waveform. Taking the last two peaks (for example, the positive peaks Vp1 and Vp2) as reference values, the controller 104*a* of the power controller block 104 judges whether or not the peak value of the second positive peak Vp2 is lower than that of the first positive peak Vp1 and whether or not the waveform has a drop to the offset voltage Voffset between the first and second positive peak Vp1 and Vp2. If the peak value of the second positive peak Vp2 is lower than that of the first positive peak Vp1 and the waveform does not have a drop to the offset voltage Voffset between the first and second positive peak Vp1 and Vp2, the controller 104*a* of the power controller block 104 then judges that a person moves away from the image forming apparatus 1.

Judging that way, the controller 104*a* of the power controller block 104 switches the power supply mode from normal operation mode to power saving mode. More specifically, the controller 104*a* of the power controller block 104 is allowed to switch the power supply mode from normal operation mode to power saving mode in an earlier stage, for example, when detecting that a person, who is close to the image forming apparatus 1, moves away therefrom without operating. This would contribute to reduction in power consumption.

Figure 7:
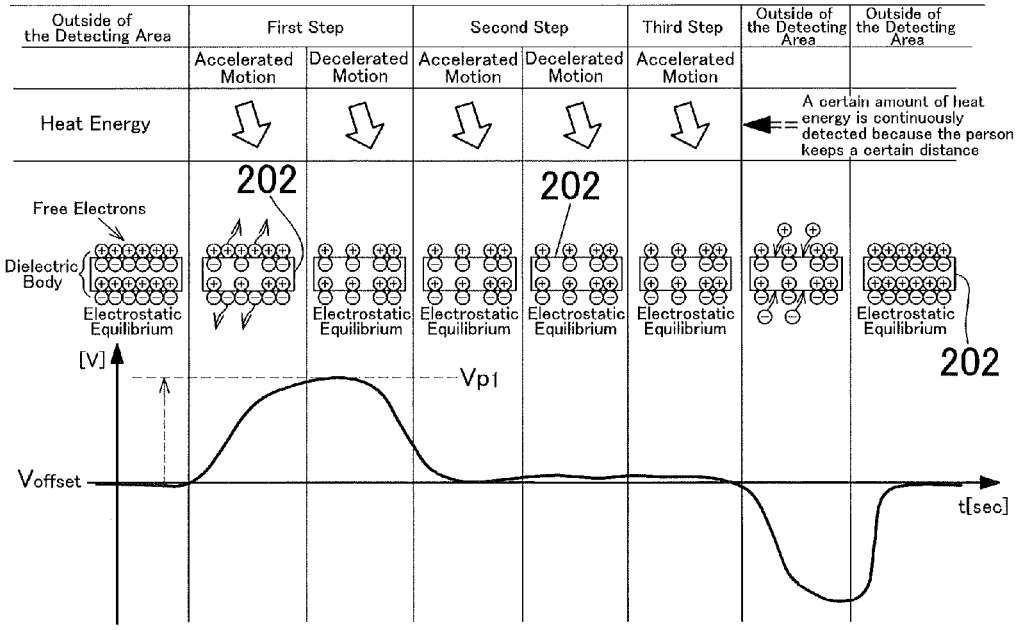
FIG. 7 illustrates charge distributions on the surface of the human body sensor and a waveform of output signals of the human body sensor when a person passes through the detecting area laterally to the image forming apparatus.

FIG. 7 illustrates charge distributions on the surface of the human body sensor 202 and a waveform of output signals of the human body sensor 202 when a person moves in the detecting area 205*a* laterally to the image forming apparatus 1 as indicated by arrow Y1 in FIG. 4B.

When a person takes a first step to enter the detecting area 205*a* from the outside, the output voltage raises because of his/her accelerated motion as mentioned previously. The person moves laterally to the image forming apparatus 1 keeping a certain distance therewith, which a certain pattern due to piezoelectric effects in the waveform.

That is, as illustrated in the waveform of FIG. 7, when the person enters the detecting area 205*a*, the output voltage reaches a positive peak Vp1 then falls to the offset voltage Voffset. And the output voltage reaches a negative peak when the person exits the detecting area 205*a*. Only by analyzing this waveform of output signals as described above, the controller (CPU) 104*a* of the power controller block 104 judges that a person moves in the detecting area 205*a* laterally to the image forming apparatus 1.

Specifically, the controller 104*a* of the power controller block 104 detects the positive peak Vp1 in the waveform and judges whether or not the waveform has a drop to the offset voltage Voffset after the positive peak Vp1. If the waveform has a drop to the offset voltage Voffset after the positive peak Vp1, the controller 104*a* of the power controller block 104 then judges that a person moves in the detecting area 205*a* laterally to the image forming apparatus 1.

The controller 104*a* of the power controller block 104 switches the power supply mode of the image forming apparatus 1 to power saving mode if the power supply mode is found to be normal operation mode while the controller 104*a* judges that a person moves in the detecting area 205*a* laterally to the image forming apparatus. Consequently the controller 104*a* of the power controller block 104 is allowed to switch the power supply mode from normal operation mode to power saving mode in an earlier stage, which would contribute to reduction in power consumption.

Figure 8:
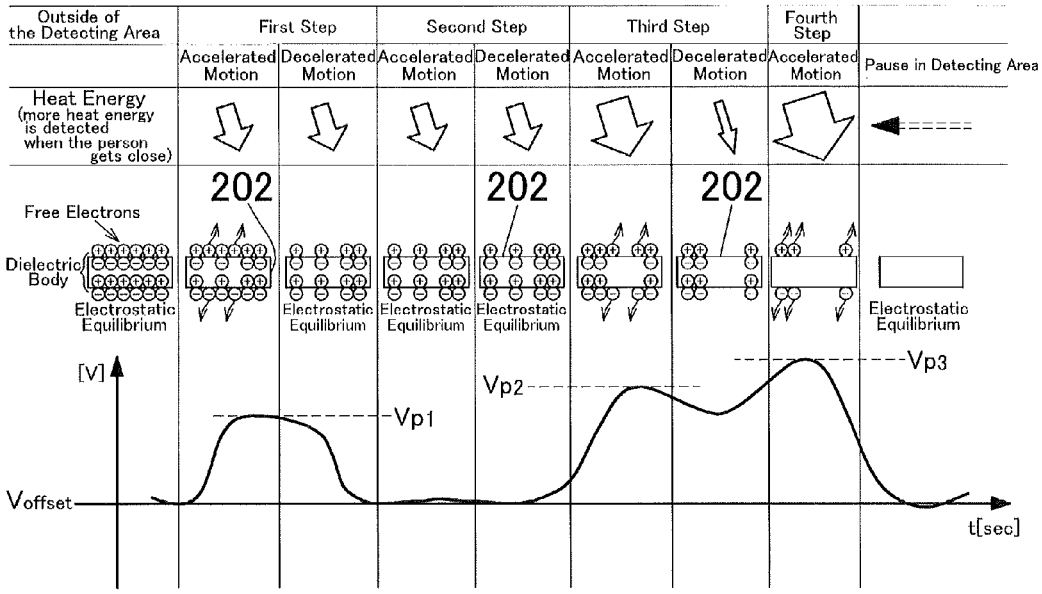
FIG. 8 illustrates charge distributions on the surface of the human body sensor and a waveform of output signals of the human body sensor when a person, who moves in the detecting area laterally to the image forming apparatus, gives a turn to move toward the image forming apparatus.

FIG. 8 illustrates charge distributions on the surface of the human body sensor and a waveform of output signals of the human body sensor 202 when a person, who moves in the detecting area 205*a* laterally to the image forming apparatus 1, gives a turn to move toward the image forming apparatus 1.

As illustrated in the waveform of FIG. 7, when a person enters the detecting area 205*a* and moves laterally to the image forming apparatus 1, the output voltage reaches a positive peak Vp1 then falls to the offset voltage Voffset.

After the positive peak Vp1, when the person gives a turn to move toward the image forming apparatus 1, the waveform will result in showing multiple positive peaks Vp2, Vp3 . . . whose peak values are greater in this order. Furthermore, the output voltage rises approximately in a staircase pattern without falling until the offset voltage Voffset between these positive peaks.

If detecting a pattern of user approach in the waveform within a certain period of time after judging that a person moves in the detecting area 205*a* laterally to the image forming apparatus 1, the controller 104*a* of the power controller block 104 then judges that the person gives a turn to move toward the image forming apparatus 1. The controller 104*a* of the power controller block 104 switches the power supply mode to normal operation mode if the power saving mode is found to be power saving mode while the controller 104*a* judges that the person gives a turn to move toward the image forming apparatus.

Figure 9:
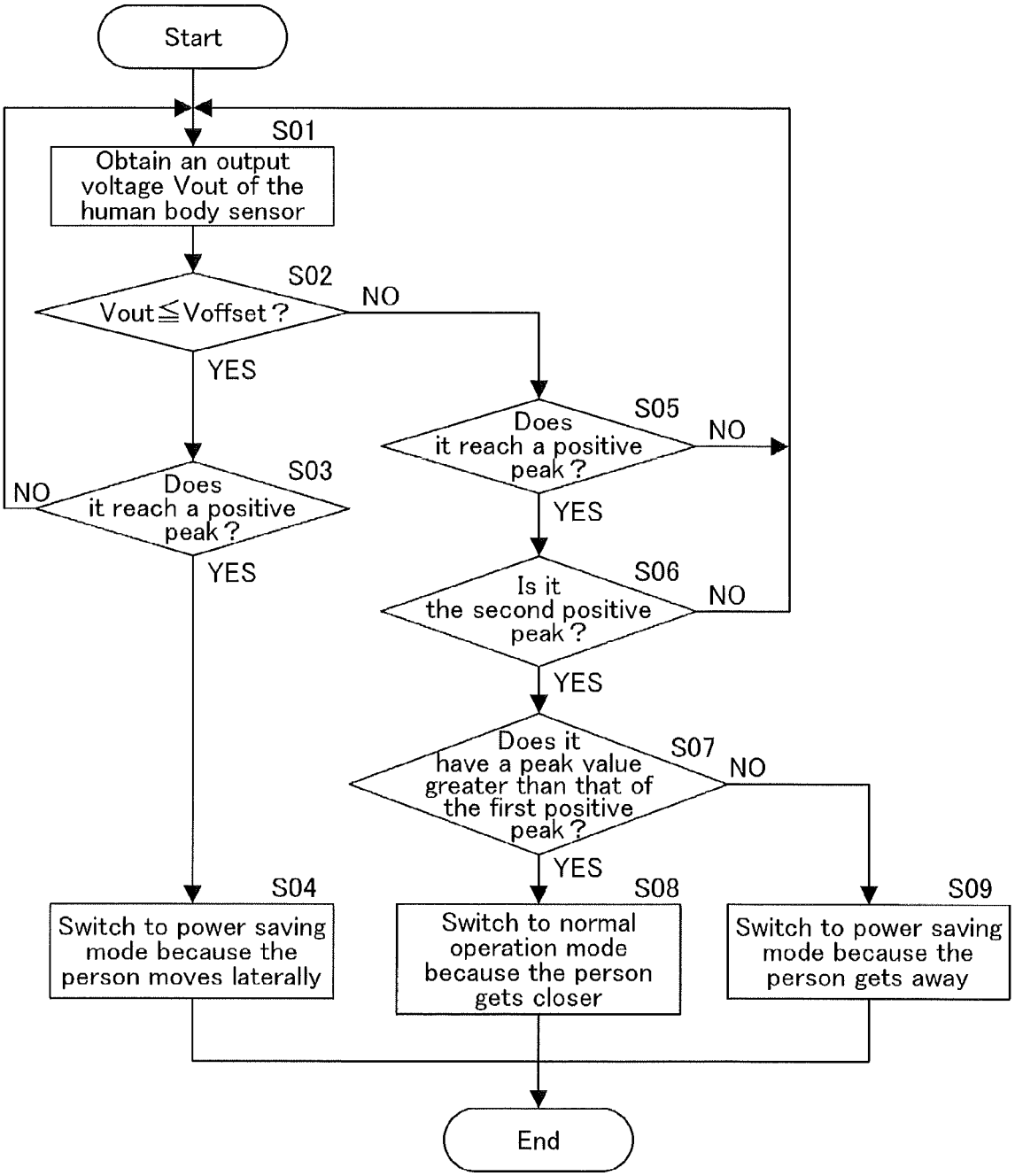
FIG. 9 is a flowchart representing a power control operation to be conducted by a controller of a power control block.

FIG. 9 is a flowchart representing a power control operation to be conducted by the controller 104*a* of the power controller block 104. The flowchart of FIG. 9 and the following flowcharts are executed by the CPU of the controller 104*a* in accordance with power control programs stored on a recording medium not shown in the figure.

In Step S01, an output voltage Vout of the human body sensor 202 is obtained; it is judged in Step S02 whether or not the output voltage Vout is equal to or lower than the offset voltage Voffset.

If the output voltage Vout is equal to or lower than the offset voltage Voffset (YES in Step S02), it is then judged in Step S03 whether or not the output voltage Vout reaches its positive peak. If the output voltage Vout reaches its positive peak (YES in Step S03), the routine proceeds to Step S04, in which it is confirmed that a person moves in the detecting area 205*a* laterally to the image forming apparatus 1 and the power supply mode of the image forming apparatus 1 is switched to power saving mode only if it is found to be normal operation mode. If the output voltage Vout has not reached its positive peak (NO in Step S03), the routine returns to Step S01.

In Step S02, if the output voltage Vout is higher than the offset voltage Voffset (NO in Step S02), it is then judged in Step S05 whether or not the output voltage Vout reaches its positive peak. This judgment is made by comparing the output voltage Vout to the last obtained output voltage Vout.

If the output voltage Vout has not reached its positive peak (NO in Step S05), the routine returns to Step S01. If the output voltage Vout reaches its positive peak (YES in Step S05), it is then judged in Step S06 whether or not it is the second positive peak. If it is not the second positive peak (NO in Step S06), the routine returns to Step S01. If it is the second positive peak (YES in Step S06), it is then judged in Step S07 whether or not the peak value of the second positive peak is greater than that of the first positive peak.

If it is greater than that of the first positive peak (YES in Step S07), the routine proceeds to Step S08 in which it is confirmed that a person moves toward the image forming apparatus 1 and the power supply mode of the image forming apparatus 1 is switched to normal operation mode only if it is found to be power saving mode. If it is not greater than that of the first positive peak (No in Step S07), the routine proceeds to Step S09 in which it is confirmed that a person moves away from the image forming apparatus 1 and the power supply mode of the image forming apparatus 1 is switched to power saving mode only if it is found to be normal operation mode.

Figure 10:
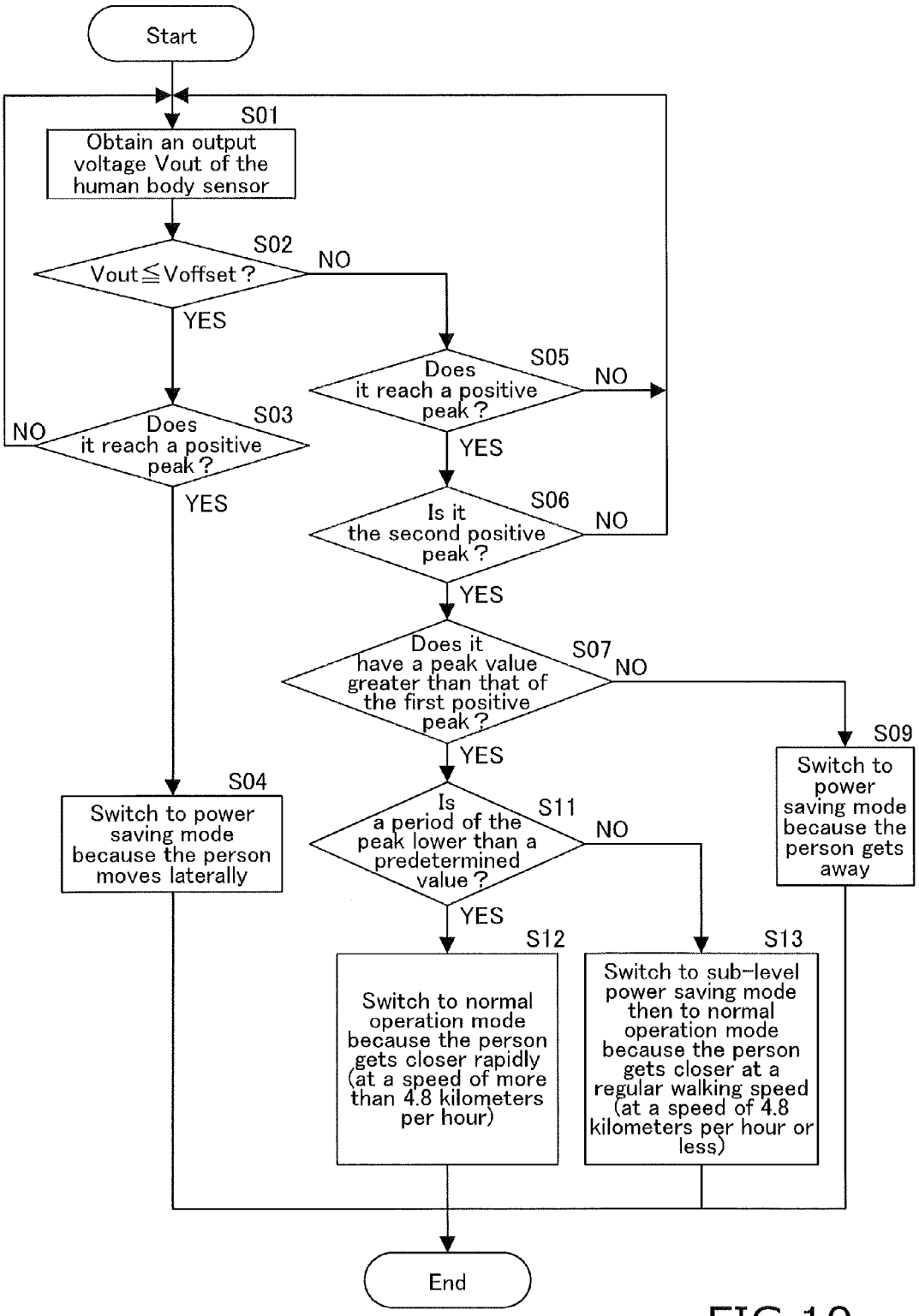
FIG. 10 is a flowchart representing another power control operation to be conducted by a controller of the power control block.

FIG. 10 is a flowchart representing another power control operation to be conducted by the controller 104*a* of the power control block 104. Depending on the speed at which a person moves toward the image forming apparatus 1, the image forming apparatus 1 switches its power supply mode in a different manner in accordance with this flowchart.

Steps S01 to S07 and Step S09 of the FIG. 10 flowchart, corresponding to the respective identically numbered steps of the FIG. 9 flowchart, which have already been covered by the description provided above, will be omitted in the following description.

In Step S07, it is judged whether or not the peak value of the second positive peak is greater than that of the first positive peak. If it is greater than that of the first positive peak (YES in Step S07), it is then judged in Step S11 whether or not the period between the first and second positive peak is equal to or lower than a predetermined value. If it is equal to or lower than a predetermined value (YES in Step S11), the routine proceeds to Step S12 in which it is confirmed that a person rapidly moves toward the image forming apparatus 1 and the power supply mode of the image forming apparatus 1 is switched to normal operation mode only if it is found to be power saving mode. If it is not equal to or lower than a predetermined value (NO in Step S11), the routine proceeds to Step S13 in which it is confirmed that a person moves toward the image forming apparatus 1 itself at a regular walking speed (for example, 4.8 kilometers per hour) or less and the power supply mode of the image forming apparatus 1 is switched to sub-level power saving mode requiring more power than power saving mode only if it is found to be power saving mode, then switched from sub-level power saving mode to normal operation mode after a certain period of time.

Figure 11:
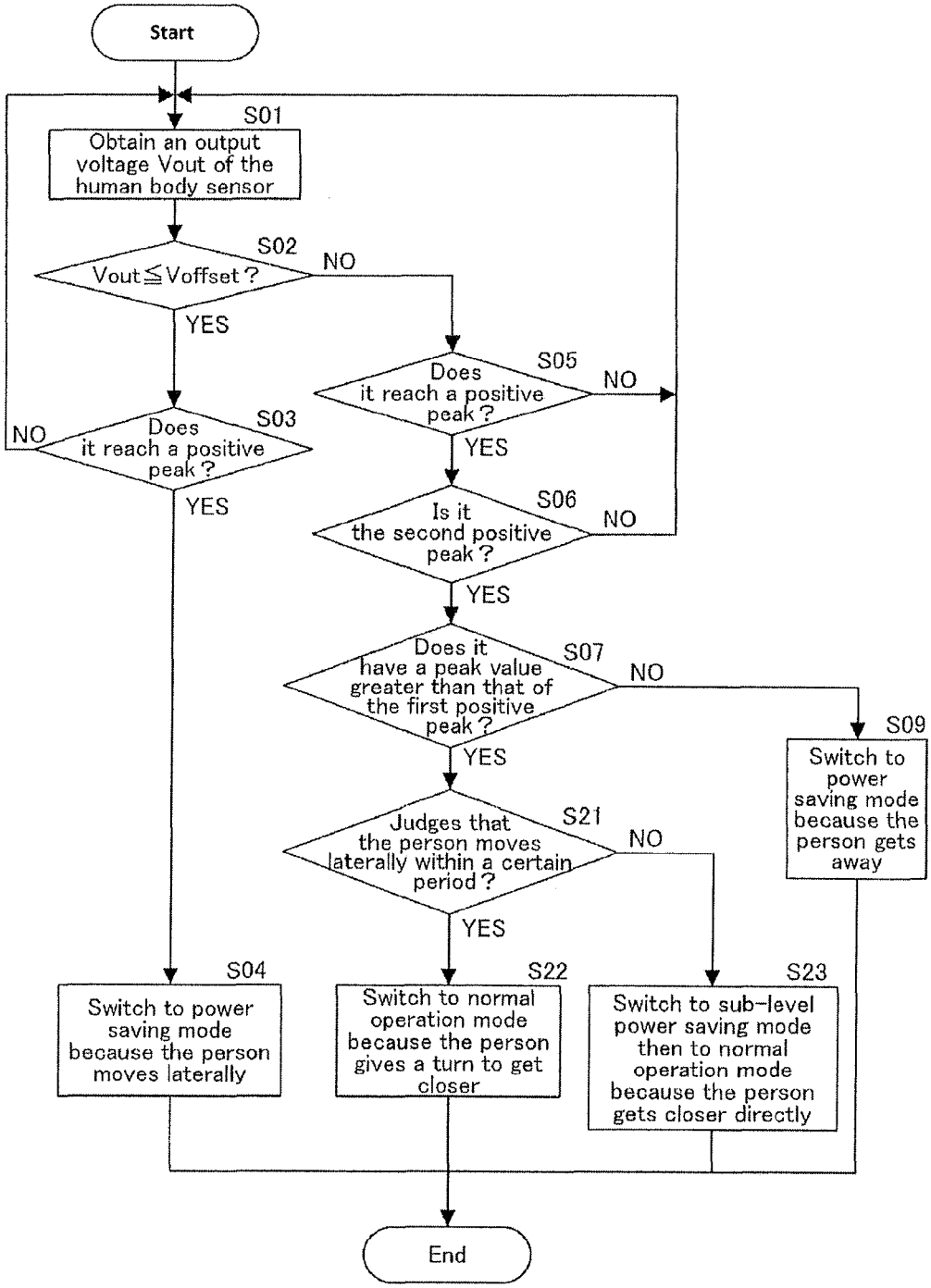
FIG. 11 is a flowchart representing yet another power control operation to be conducted by a controller of the power control block.

FIG. 11 is a flowchart representing yet another power control operation to be conducted by the controller 104*a* of the power control block 104. When a person, who moves in the detecting area 205*a* laterally to the image forming apparatus 1, gives a turn to move toward the image forming apparatus 1, the image forming apparatus 1 switches its power supply mode in accordance with this flowchart.

Steps S01 to S07 and Step S09 of the FIG. 11 flowchart, corresponding to the respective identically numbered steps of the FIG. 9 flowchart, which have already been covered by the description provided above, will be omitted in the following description.

In Step S07, it is judged whether or not the peak value of the second positive peak is greater than that of the first positive peak. If it is greater than that of the first positive peak (YES in Step S07), it is then judged in Step S21 whether or not it was YES in Step S04 in the last certain period of time (for example, in the last two seconds). In other words, it is judged whether or not the image forming apparatus 1 recognizes that a person moves toward the image forming apparatus 1 itself, within a certain period of time after recognizing that he/she moves in the detecting area 205*a* laterally to the image forming apparatus 1 itself.

If it was YES in Step S04 in the last certain period of time (YES in Step S21), the routine proceeds to Step S22 in which it is confirmed that a person gives a turn to move toward the image forming apparatus 1 and the power supply mode of the image forming apparatus 1 is switched to normal operation mode only if it is found to be power saving mode. If it was NO in Step S04 in the last certain period of time (NO in Step S21), the routine proceeds to Step S23 in which it is confirmed that a person moves directly towards the image forming apparatus 1 and the power supply mode of the image forming apparatus 1 is switched to sub-level power saving mode requiring more power than power saving mode only if it is found to be power saving mode, then switched from sub-level power saving mode to normal operation mode after a certain period of time.

While the first embodiment of the present invention has been described in detail herein and shown in the accompanying drawings, it should be understood that the present invention is not limited to the foregoing embodiment.

For example, in the first embodiment, the image forming apparatus 1 returns to normal operation mode from power saving mode when recognizing that a person moves toward the image forming apparatus 1 itself. Alternatively, the image forming apparatus 1 may go to sub-level power saving mode when recognizing that a person enters the detecting area 205*a* by comparing the output voltage to a threshold; subsequently the image forming apparatus 1 may return to normal operation mode when further recognizing that the person moves toward the image forming apparatus 1 itself by comparing the output voltage to another threshold.

Furthermore, in the flowcharts of FIGS. 10 and 11, the image forming apparatus 1 judges if a person moves toward the image forming apparatus 1 itself, on the basis of two peaks that are currently and last obtained, for example. If the detecting area 205*a* is spacious enough for a user to take three or more steps therein, the image forming apparatus 1 may do the same on the basis of three or more peaks (FIG. 5 shows an example with three peaks). Specifically, when the output voltage has reached three or more positive peaks consecutively, the image forming apparatus 1 judges if a person moves toward or away from the image forming apparatus 1 itself, depending on the mean value of the differences in peak value between two consecutive peaks or calculates a period using the mean value of the intervals between two consecutive peaks.

Second Embodiment

A second embodiment of the present invention will be described with reference to FIGS. 12 to 20. A human body detecting device 2000 according to the second embodiment is different from the human body detecting device 200 according to the first embodiment in the following aspect: it forms first detecting areas 2050*a* and 2050*b* each serving to detect if a user moves toward or away from the main body 10 of the image forming apparatus 1; it also forms a second detecting area 2050*c* serving to detect if a user takes any action, near the main body 10 of the image forming apparatus 1; and it also forms a non-detecting area 2050*d* not serving to detect infrared energy, between the first and second detecting area 2050*b* and 2050*c* (this will be described in detail with reference to FIG. 14). In the second embodiment, some structure members correspond to the respective identically numbered structure members of the first embodiment and these will be omitted in the following description.

Figure 12:
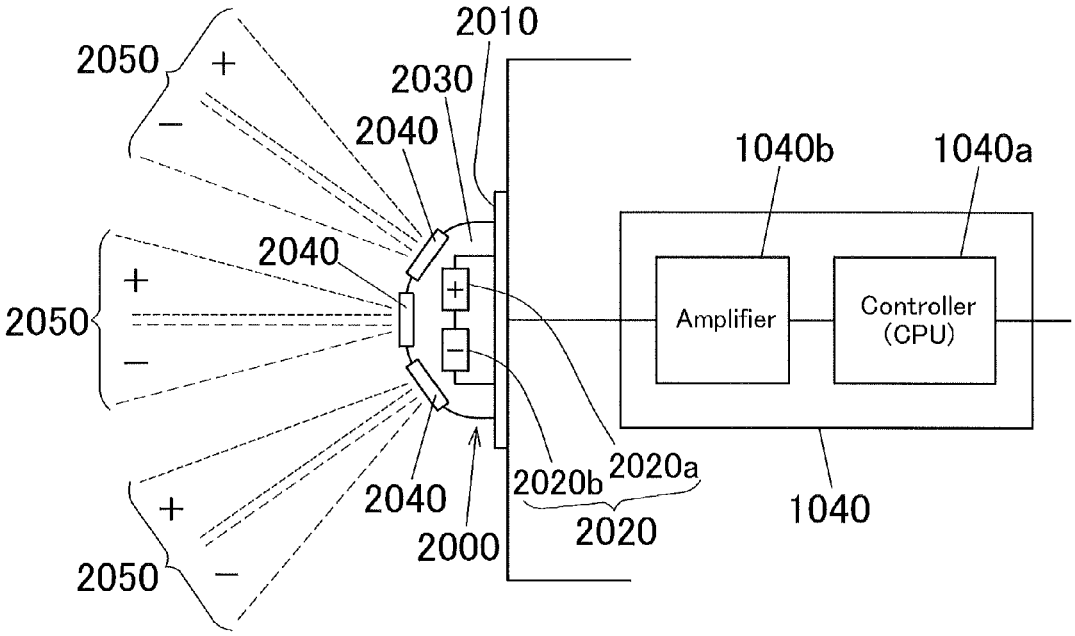
FIG. 12 is a view to explain a human body detecting device according to a second embodiment of the present invention.

As illustrated in FIG. 12, the human body detecting device 2000 according to the second embodiment is provided with: a human body sensor 2020 being positioned on a board 2010; and a fly-eye lens 2030 that is a Fresnel lens with a plurality of single lenses 2040 being arranged in a matrix, the fly-eye lens 2030 being attached to the board 2010 such that it covers the human body sensor 2020.

The human body sensor 2020 is comprised of a piezoelectric sensor having a pair of a positive electrode 2020*a* and a negative electrode 2020*b*, which produces a different output depending on the amount of incoming infrared energy. It should be understood that the human body sensor 2020 is in no way limited to a specific number or configuration.

The human body detecting device 2000, having such a configuration as described above, is allowed to form a human body detecting space 2050 that detects infrared energy emitted by a human body (bare parts of a human body, specifically, the face, arms, and hands). The human body detecting space 2050 radially extends outside of each single lens 2040 of the fly-eye lens 2030, which means that the number of the human body detecting spaces 2050 is equal to the number of the single lenses 2040. The human body detecting space 2050 consists of a space serving for the positive electrode 2020*a* to detect infrared energy and another space serving for the negative electrode 2020*b* to detect infrared energy.

Figure 13A:
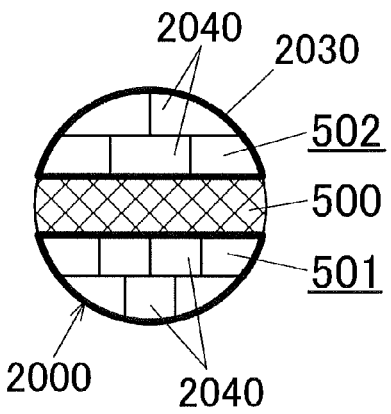
FIGS. 13A and 13B are a schematic plan view illustrating a lens of the human body detecting device.

In this embodiment, as illustrated in FIG. 13A, the fly-eye lens 2030 is a polyhedral globe, consisting of: a first single-lens group 501 being fixed at a side of the curved surface of the fly-eye lens 2030 (the upper one in FIG. 13A); a second single-lens group 502 being fixed at the opposite side of the curved surface of the fly-eye lens 2030 (the lower one in FIG. 13A); and a block portion 500 (indicated by crosshatching in FIG. 13) being configured to prevent infrared energy from being conducted to the human body sensor 2020, the block portion 500 being sandwiched in between the first single-lens group 501 and the second single-lens group 502. The first single-lens group 501 and second single-lens group 502 each consists of the plurality of single lens 2040 being arranged side by side in two rows.

Figure 13B:
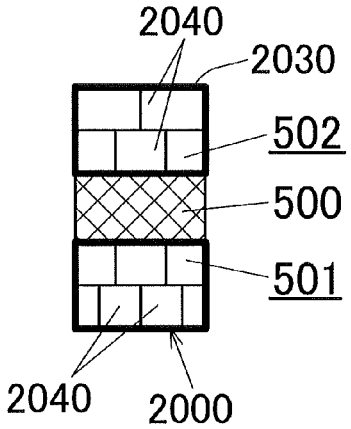

It should be understood that the fly-eye lens 2030 is in no way limited to a specific shape and the single lenses 2040 are in no way limited to a specific number or arrangement. For example, the fly-eye lens 2030 may be a polyhedral cuboid as illustrated in FIG. 13B. In this case, as illustrated in FIG. 13B, the fly-eye lens 2030 consists of: a first single-lens group 501 being fixed on a surface of the fly-eye lens 2030 itself (the upper one in FIG. 13B); a second single-lens group 502 being fixed on the opposite surface of the fly-eye lens 2030 itself (the lower one in FIG. 13B); and a block portion 500 that blocks infrared energy, the block portion 500 being sandwiched in between the first single-lens group 501 and the second single-lens group 502.

Figure 14A:
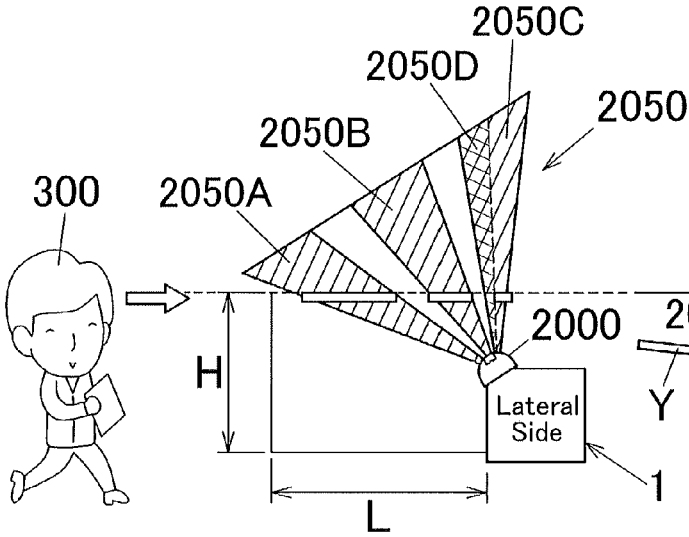
FIG. 14A is a schematic view illustrating the image forming apparatus laterally for a better understanding of the direction and the detecting area of the human body detecting device.

The human body detecting device 2000, having such a configuration as described above, is installed at a position near the operation panel 102 of the main body 10 of the image forming apparatus 1 such that the center of the human body detecting device 2000 is directed obliquely upward as illustrated in FIG. 14A. As illustrated in FIG. 14A, the human body detecting device 2000, having the fly-eye lens 2030, forms first detecting spaces 2050A and 2050B just in front of the image forming apparatus 1 (between a user and the image forming apparatus 1), the first detecting spaces 2050A and 2050B each radially extending outside of the human body detecting device 2000 itself; it also forms a second detecting space 2050C near the main body 10 of the image forming apparatus 1, the second detecting space 2050C radially extending outside of the human body detecting device 2000 itself; and it also forms a non-detecting space 2050D not serving to detect infrared energy, by the block portion 500 of the fly-eye lens 2030, the non-detecting space 2050D radially and almost vertically extending outside of the human body detecting device 2000 itself, the non-detecting space 2050D being sandwiched in between the first detecting space 2050B and the second detecting space 2050C.

The first detecting spaces 2050A and 2050B are formed by the single lenses 2040 from the first single-lens group 501 of the fly-eye lens 2030; the second detecting space 2050C is formed by the single lenses 2040 from the second single-lens group 502 of the fly-eye lens 2030.

Figure 14B:
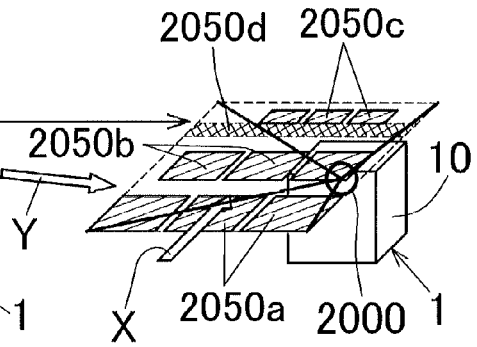
FIG. 14B is a schematic view illustrating the image forming apparatus squarely and obliquely downward from top for a better understanding of the detecting area of the human body detecting device.

FIG. 14B illustrates a horizontal plane of the detecting space 2050 including the first detecting spaces 2050A and 2050B and the second detecting space 2050C, along with a person who may move as indicated by arrows. Specifically, in the horizontal plane, there are first detecting areas 2050*a* and 2050*b* just in front of the image forming apparatus 1 (between a user and the image forming apparatus 1); second detecting areas 2050*c* near the main body 10 of the image forming apparatus 1; and a non-detecting area 2050*d* not serving to detect infrared energy and looking like a band stretching side to side, the non-detecting area 2050*d* being sandwiched in between the row of the first detecting areas 2050*a* and 2050*b* and the row of the second detecting areas 2050*c*, near the front edge of the top surface of the image forming apparatus 1, in parallel with the top surface.

The first detecting areas 2050*a* and 2050*b* are arranged side by side in their respective rows in order to detect if a person moves laterally to the image forming apparatus 1 (in a Y or opposite Y direction) and detect if a person moves toward or away from the image forming apparatus 1 (in an X and opposite X direction). The detecting areas 2050*b*, to which the image forming apparatus 1 is closer than to the detecting areas 2050*a*, are smaller than the first detecting areas 2050*a* in their size. The first detecting areas 2050*a*, which are arranged side by side in a row, are almost identical in their size; the first detecting areas 2050*b*, which are arranged side by side in another row, are almost identical in their size.

The second detecting areas 2050*c* are arranged side by side in one or more rows in order to detect if a person moves laterally to the image forming apparatus 1 (in a Y or opposite Y direction) and detect if a person moves toward or away from the image forming apparatus 1 (in an X and opposite X direction).

The positive electrode 2020*a* and the negative electrode 2020*b* are arranged inside of the human body sensor 2020 such that a person moving toward the image forming apparatus 1 will enter a positive and negative area of the first detecting area 2050*a*, a positive and negative area of the first detecting area 2050*b*, and a positive and negative area of the second detecting area 2050*c*, in this order.

The first detecting areas 2050*a* and 2050*b* serve to detect if a user moves toward the image forming apparatus 1; the second detecting areas 2050*c* serve to detect if a user, who is close to the image forming apparatus 1, takes any action. For example, when a user stretches out his/her arm to the operation panel 102 or the automatic document feeder 103*a*, it will be judged that he/she has an intention to operate the image forming apparatus 1.

Specifically, in this embodiment, the first detecting areas 2050*a* arranged in the outer row are allowed to detect heat energy from the face of a person of 170 centimeters in height who moves toward the image forming apparatus 1 at a speed of 4.8 kilometers per hour, when he/she reaches in an office a position L that is 2.5 meters away from the image forming apparatus 1, only two more seconds before the image forming apparatus 1.

Figure 15A:
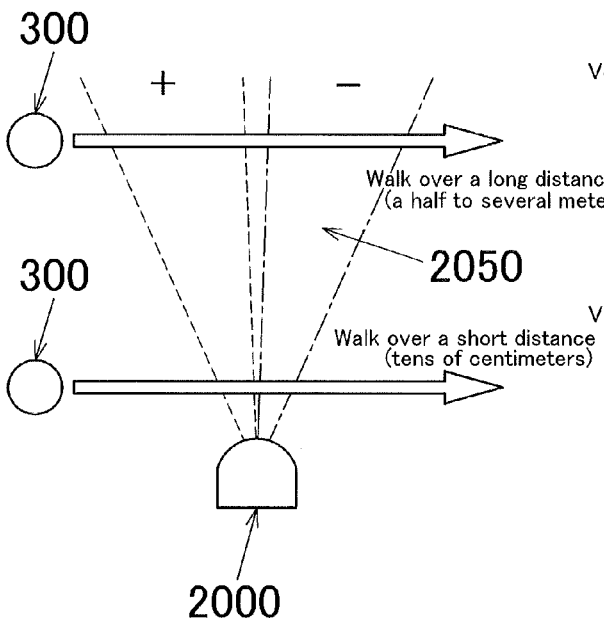
FIGS. 15A and 15B are a view to explain an ordinary operation of a human body sensor.
Figure 15B:
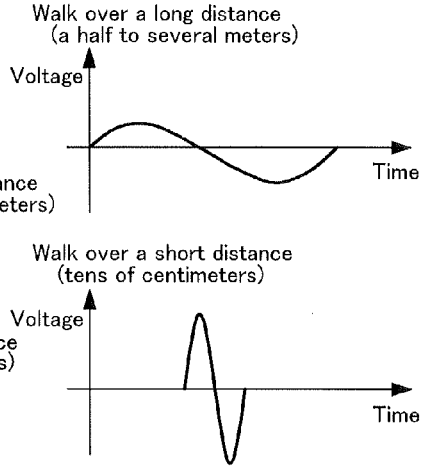

FIG. 15A illustrates examples in which a person 300 enters one of the detecting areas 2050 and moves through its positive and negative area in this order, as indicated by arrows. In FIGS. 15A and 15B, the person 300 moves at an identical speed both in the examples. When the person 300 enters the positive area, the human body sensor 2020 detects infrared energy emitted by the person 300 and the output voltage rises to form a positive wave; and then when the person 300 enters the negative area, the human body sensor 2020 detects infrared energy emitted by the person 300 and the output voltage drops to form a negative wave. That is, when the persons 300 enters and moves through the one detecting area 2050, the human body sensor 2020 produces an output signal having a waveform with a positive and negative peak. After the person 300 leaves the detecting area 2050, the output voltage returns to the offset voltage. When the person 300 enters and moves through the one detecting area 2050 in reverse direction, the human body sensor 2020 produces an output signal having an inverse waveform. The output signal is input to the controller 104*a* through the amplifier 104B of the power controller block 104 as illustrated in FIG. 12.

Peak values (also referred to as peak voltage) change depending on the amount of infrared energy. Output frequency also changes depending on the size of the detecting area 2050 and the speed at which the person 300 moves through the detecting area 2050. Therefore, as illustrated in FIGS. 15A and 15B, when the person 300 moves through the detecting area 2050 at a certain speed keeping a certain distance with the human body sensor 2020, the output signal will have peak values and frequency that are greater and higher than those in the other example when the person does all the same but keeping a larger distance with the human body sensor 2020. Output frequency becomes higher with a faster moving speed of the person 300.

Hereinafter, the operation to be performed by the image forming apparatus 1 of FIGS. 1 and 2 when a user enters any of the first detecting areas 2050*a* from the outside and moves toward the image forming apparatus 1 as indicated by arrow X of FIG. 14B, will be described with reference to FIGS. 16 and 17.

Figure 16:
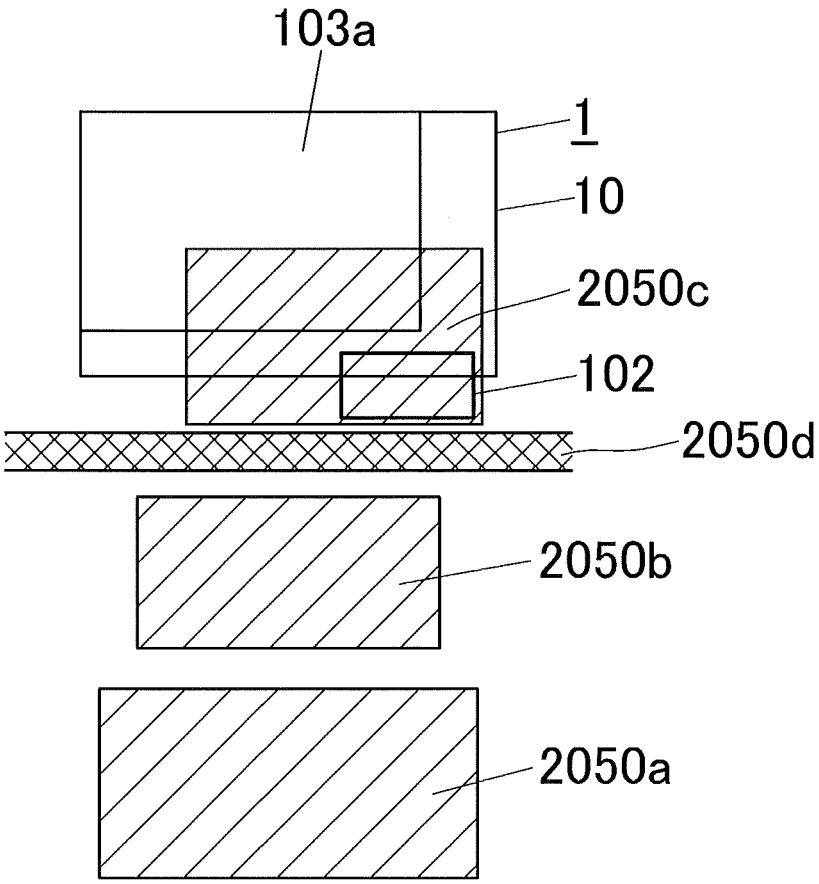
FIG. 16 is a schematic plan view illustrating the positions of the image forming apparatus and the detecting area.

For the sake of simplicity, one of the first detecting areas 2050*a* in a row, one of the first detecting areas 2050*b* in another row, and one of the second detecting areas 2050*c* in yet another row, as illustrated in FIG. 16, will be explained. One the second detecting area 2050*c* is located in only one row over the operation panel 102 and the automatic document feeder 103*a* such that the human body sensor 2020 will detect infrared energy if the user stretches out his/her arm toward the operation panel 102 or the automatic document feeder 103*a*.

Figures 17A, 17B, 17C:
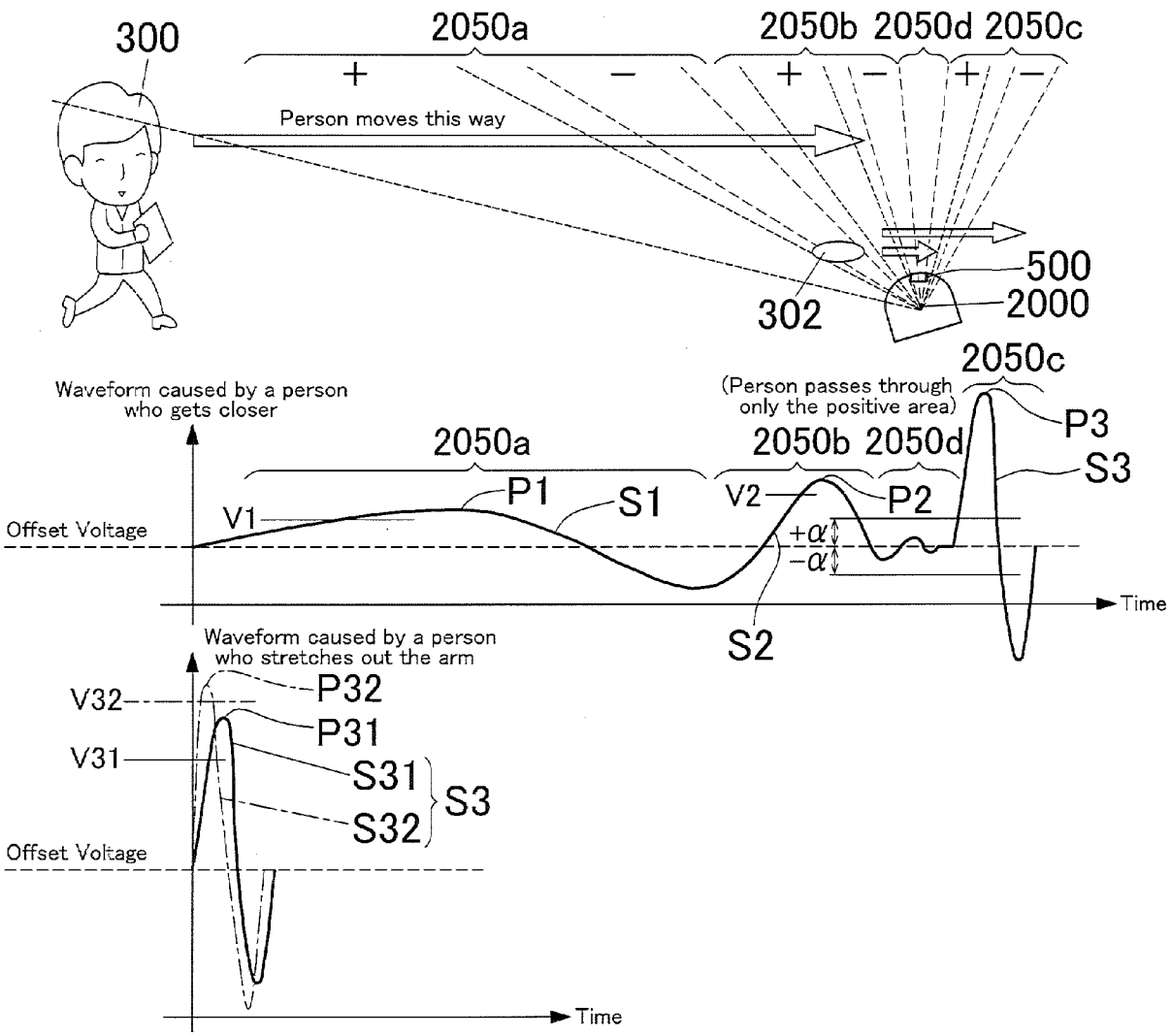
FIGS. 17A, 17B, and 17C illustrate active detecting areas of the human body sensor and a waveform of output signals of the human body sensor when a person moves toward the image forming apparatus to put his/her hand close thereto.

When a user enters the first detecting area 2050*a* in the outer row from the outside as illustrated in FIG. 17A, the human body sensor 2020 detects infrared energy emitted by the user and produces output signals as illustrated in FIG. 17B.

As is mentioned previously, the human body sensor 2020 has the following characteristics because of its piezoelectric element: when detecting that infrared energy source enters the first detecting area 2050*a*, from its positive area to its negative area, the human body sensor 2020 will produce an output signal having a waveform with a positive and negative peak based on the offset voltage (when detecting that infrared energy source moves in reverse direction, it will produce an output signal having a reverse waveform); and then, when missing the infrared energy source, the human body sensor 2020 does not produce any output signal. That is, the human body sensor 2020 produces different output voltages and output frequencies depending on the amount of infrared energy, the size of the first detecting area 2050*a*, the moving speed of a user, and the like. Here, the human body sensor 2020 produces an output signal S having a waveform with a positive and negative peak. It can be judged which detecting area the person 300 enters, the first detecting area 2050*a* or 2050*b*, by analyzing the output signal S, which will be further described below. Hereinafter, the human body sensor 2020 produces an output signal S1 (also output signals S2 and S3) when detecting that the person 300 enters the first detecting area 2050*a*.

When the user further enters the first detecting area 2050*b* in the second outer row and pauses there, the output signal S2 has a waveform with a positive peak whose peak value is greater than that of the output signal S1. That is because: the amount of infrared energy is inversely proportional to the square of the distance; and the ratio of the size of the user's face to the first detecting area 2050*b* is larger than that of the user's face to the first detecting area 2050*a*. In addition, the waveform has a shorter period (a higher frequency) than that of the output signal S1 because the size of the first detecting area 2050*b* is smaller than that of the first detecting area 2050*a*.

It can be judged which detecting area the user enters, the first detecting area 2050*a* or 2050*b*, by analyzing the output voltage of the human body sensor 2020.

In other words, an output signal of the human body sensor 2020 is input to the controller (CPU) 104*a* through the amplifier 104B of the power controller block 104. The peak value of the output signal is compared to voltage thresholds V1 and V2 for detecting user approach, by the controller 104*a*. The voltage threshold V1 for detecting user approach is set in advance to a lower value than the peak value P1 of the output signal S1; the voltage threshold V2 for detecting user approach is set in advance to a value that is greater than the peak value P1 of the output signal S1 and lower than the peak value P2 of the output signal S2.

If the output signal has a peak value P that satisfies the following inequality: voltage threshold V1<peak value P≤voltage threshold V2, the controller 104*a* judges that the user enters the first detecting area 2050*a* in the outer row; if the output signal has a peak value P that satisfies the following inequality: voltage threshold V2<peak value P, the controller 104*a* judges that the user enters the first detecting area 2050*b* in the second outer row.

Alternatively, it can be judged which detecting area the user enters, the first detecting area 2050*a* or 2050*b*, by analyzing the output frequency of the human body sensor 2020. In this case, the frequency threshold F1 is set in advance to a lower value than that of the output signal S1; the frequency threshold F2 is set in advance to a value that is greater than that of the output signal S1 and lower value than that of the output signal S2. If the output signal has a frequency F that satisfies the following inequality: frequency threshold F1<frequency F≤frequency threshold F2, the controller 104*a* will judge that the user enters the first detecting area 2050*a* in the outer row; if the output signal has a frequency F that satisfies the following inequality: frequency threshold F2<frequency F, the controller 104*a* will judge that the user enters the first detecting area 2050*b* in the second outer row.

Before detecting that the user enters the first detecting area 2050*a* in the outer row, the controller 104*a* sets the power supply mode of the image forming apparatus 1 to power saving mode in order to cut off power supply to any of the image processor block 100, the engine controller block 101, and the operation panel 102. When detecting that the user enters the first detecting area 2050*a* in the outer row, the controller 104*a* judges that the user seems likely to have an intention to operate the image forming apparatus 1, therefore lowers the power saving level by selecting an operation mode for restoring power supply to the image processor block 100. That is because it takes long for the controller (CPU) 100*d* of the image processor block 100 to return to normal. It should be understood that, when the user enters the first detecting area 2050*a* in the outer row, the image forming apparatus 1 sometimes may be already in that for normal operation (normal operation mode) shortly after the last operation or for another reason. In this case, as a matter of course, the controller 104*a* will keep that mode. The same is true for the power control operations to be described below.

When detecting that the user further enters the first detecting area 2050*b* in the second outer row, the controller 104*a* judges that the user gets closer to the image forming apparatus 1 and seems more likely to have an intention to operate the image forming apparatus 1, therefore lowers the power saving level by selecting an operation mode for restoring power supply to the engine controller block 101 and the operation panel 102. Actually, the controller 104*a* restores power supply to the controller (CPU) 101*b* of the engine controller block 101 first; therefore, a motor and other portions of the engine controller 101 do not start operation and the operation panel 102 does not turn on the backlight, at this point.

As to be described below, the controller 104*a* restores power supply to the operation panel 102 to have it turn on the backlight, only when detecting that the user further enters any of the second detecting areas 2050*c*.

Here is another example: when a user moves through multiple the first detecting areas 2050*a* in the outer row laterally to the image forming apparatus 1 as indicated by arrow Y of FIG. 14B, the human body sensor 2020 produces an output signal having a waveform with almost the same peak values and a constant period because the sizes of the multiple first detecting areas 2050*a* are identical and the user moves at a constant speed. In this case, when detecting that the user enters any of the first detecting areas 2050*a* in the outer row, the controller 104*a* switches the power supply mode from power saving mode to sub-level power saving mode in order to restore power supply to the image processor block 100, the engine controller block 101, and the like, which does not mean the entire image forming apparatus 1 is allowed to recover to normal. When detecting that the user further enters another one of the first detecting areas 2050*a* in the outer row, the controller 104*a* judges that the user does not have an intention to operate the image forming apparatus 1, therefore switches the power supply mode to power saving mode again.

The power control operations as described above would achieve low power consumption without sacrificing user convenience.

In the embodiment as described above, the image forming apparatus 1 consumes less power in power saving mode than that for image forming that is normal operation. It should be understood that the method of changing the power supply mode by the controller (CPU) 104*a* of the power supply block 104, which is allowed to select among multiple power supply modes, is in no way limited to this embodiment. For example, the multiple power supply modes may include: an operation mode for restoring power supply to the image scanner 103 and the operation panel 102; and an operation mode for restoring power supply to the engine controller block 101, in addition to an operation mode for restoring power supply to the image processor block 100. In this embodiment, the first detecting areas 2050*a* and 2050*b* are arranged side by side in the two respective adjacent rows. Alternatively, the first detecting areas 2050*a* and 2050*b* may be arranged side by side in more than two rows so that the controller 104*a* can select among more power supply modes, as a user gets closer to the image forming apparatus 1.

Hereinafter, the operation to be performed by the image forming apparatus 1 when a user, who is in the first detecting area 2050*b* in the second outer row, stretches out his/her arm toward the operation panel 102 or the automatic document feeder 103*a* of the image forming apparatus 1, will be described below.

The user enters any of the second detecting areas 2050*c* by stretching out his/her arm forward. When detecting that the user enters any of the second detecting areas 2050*c*, the human body sensor 2020 produces an output signal S3. In contrast, when the user enters the non-detecting area 2050*d*, the human body sensor 2020 produces an output signal having the offset voltage, and the output voltage remains at around the offset voltage until the user exits the non-detecting area 2050*d*. In this embodiment, after the output voltage of the human body sensor 2020 reaches the offset voltage, the time the output voltage continues to satisfy the following inequality: (offset voltage−α)<output voltage<(offset voltage+α) is measured as a non-detecting time. The symbol α represents a constant value that is set in advance.

If the non-detecting time is not greater than a predetermined value, it will be confirmed that the user has exited the non-detecting area 2050*d*.

In general, a person walks faster than moving his/her arm forward. In fact, the average person do walk faster than moving his/her arm: the average person walks at a speed of 4.8 kilometers per hour and moves his/her arm at a speed of 10 centimeters per second that is equal to 0.36 kilometers per hour. Meanwhile, as a matter of course, when a user, who is close to the image forming apparatus 1, stretches out his/her arm to operate the image forming apparatus 1, the human body sensor 2020 is closer to the arm than to the body (specifically, the user's face). The human body sensor 2020 is therefore allowed to detect the arm with a high degree of accuracy by the small detecting area 2050*c* as illustrated in FIG. 17A. That also causes a waveform with a great peak value and a short period (see FIG. 15). In other words, when a user's hand is very close to the human body sensor 2020, the distance between the human body sensor 2020 and an object is more dominant than the moving speed of the object, the human body sensor 2020 therefore produces an output signal having a great voltage and a high frequency. To explain the same with FIG. 17B, when a user enters any of the second detecting areas 2050*c* by his/her hand, the human body sensor 2020 produces the output signal S3 having a peak value P3 and a frequency that are greater and higher than those of a peak value P2 of the output signal S2 when a user enters any of the first detecting areas 2050*b* in the second outer row.

It is only necessary for a user to stretch out his/her arm forward just a little to operate the operation panel 102, which is positioned near the front of the image forming apparatus 1. In comparison to this, it is necessary for a user to stretch out his/her arm forward more to operate the automatic document feeder 103*a*.

When stretching out his/her arm to operate the automatic document feeder 103*a*, a user enters any of the second detecting areas 2050*c* both by his/her arm and hand, which causes the human body sensor 2020 detect more infrared energy than that when a user stretches out his/her arm to operate the operation panel 102. At the same time, the user moves his/her arm more rapidly than when a user stretches out his/her arm to operate the operation panel 102.

To explain the same with an enlarged image of a waveform in FIG. 17C, when a user stretches out his/her arm to operate the automatic document feeder 103*a*, the human body sensor 2020 produces an output signal S32 (indicated by chained line) having a greater peak value and a higher frequency than those of an output signal S31 (indicated by solid line) when a user stretches out his/her arm to operate the operation panel 102.

In this embodiment, voltage thresholds V31 and V32 are set in advance in order to detect the output signals S31 and S32, respectively. The voltage threshold V31 is greater than the peak value P2 of the output signal S2 to be produced when a user enters any of the first detecting areas 2050*b* in the second outer row and is lower than the peak value P31 of the output signal S31 to be produced when a user is about to operate the operation panel 102. The voltage threshold V32 is greater than the peak value P31 of the output signal S31 and is lower than the peak value P32 of the output signal S32 to be produced when a user is about to operate the automatic document feeder 103*a*.

If the peak value P3 of the output signal S3 satisfies the following inequality: V31<P3≤V32, the controller 104*a* of the power controller block 104 judges that that the user is about to operate the operation panel 102. The controller 104*a* therefore switches the power supply mode to normal operation mode and also allows the operation panel 102 to turn on the backlight and display an initial operation screen for the normal operation mode. This operation screen allows the user to select a function mode such as copy or facsimile.

If the peak value P3 of the output signal S3 satisfies the following inequality: V32<P3, the controller 104*a* of the power controller block 104 judges that the user is about to operate the automatic document feeder 103*a*. The controller 104*a* therefore switches the power supply mode to normal operation mode and also allows the operation panel 102 to turn on the backlight and display an initial operation screen for the automatic document feeder 103*a*. This operation screen allows the user to perform detail settings for scanner mode and set the number of copies, paper type, and other options.

Alternatively, the output signal S3 may be identified on the basis of its frequency instead of its voltage. Specifically, frequency thresholds F31 and F32 may be set in advance: the frequency threshold F31 is higher than a frequency F2 of the output signal S2 to be produced when a user enters any of the first detecting areas 2050*b* and lower than a frequency of the output signal S31 to be produced when a user is about to operate the operation panel 102; and the frequency threshold F32 is greater than the frequency threshold F31 and lower than a frequency of the output signal S32 to be produced when a user is about the operate the automatic document feeder 103*a*. In this case, if the frequency F3 of the output signal S3 satisfies the following inequality: F31<F3≤F32, the controller 104*a* of the power controller block 104 will confirm that the user is about the operate the operation panel 102; if the frequency F3 of the output signal S3 satisfies the following inequality: F32<F3, the controller 104*a* of the power controller block 104 will confirm that the user is about the operate the automatic document feeder 103*a*. The controller 104*a* of the power controller block 104 therefore switches the power supply mode to normal operation mode and also allows the operation panel 102 to turn on the backlight and display a suitable screen.

As described above, in this embodiment, when a user, who is in any of the first detecting areas 2050*b* in the second outer row, stretches out his/her arm to operate the image forming apparatus 1, the image forming apparatus 1 judges that the user enters any of the second detecting areas 2050*c* with an intention to operate the image forming apparatus 1 and switches its power supply mode to normal operation mode. In comparison to the conventional technique of switching the power supply mode only if any button is pressed on the operation panel 102 or an electrostatic sensor installed on the operation panel 102 detects a user's hand is close to the operation panel 102, the image forming apparatus 1 is allowed to decrease user wait time before it becomes ready for operation, by judging in an early stage which power supply mode should be selected.

Furthermore, in this embodiment, the non-detecting area 2050*d* is formed between the row of the first detecting areas 2050*b* and the row of the second detecting areas 2050*c*. By the presence of the non-detecting area 2050*d*, the output signal shows a clear sign whether the user enters any of the first detecting areas 2050*b* by moving toward the image forming apparatus 1 or any of the second detecting areas 2050*c* by moving a part of his/her body forward. Also by the presence of the non-detecting time, the output signal can be identified with a high degree of accuracy, as: whether or not the output signal S2 produced when a user enters any of the first detecting areas 2050*b* in the second outer row: and whether or not the output signal S3 produced when a user enters any of the second detecting areas 2050*c*. That leads to achieving in judging with a high degree of accuracy whether or not a user has an intention to operate the image forming apparatus 1.

Here, it is preferred for the controller 104*a* of the power controller block 104 to switch the power supply mode to normal operation mode, only if the peak value P3 of the output signal S3 becomes greater than the voltage threshold V31 or the frequency of the output signal S3 becomes higher than the frequency threshold F31, within a certain period of time after a user enters any of the first detecting areas 2050*b*. That is, if the peak value P3 of the output signal S3 does not become greater than the voltage threshold V31 or the frequency of the output signal S3 does not become higher than the frequency threshold F31, within a certain period of time after a user enters any of the first detecting areas 2050*b*, then this user, who is even close to the image forming apparatus 1, does not seem likely to have an intention to operate without entering any of the second detecting areas 2050*c* by stretching out his/her arm forward. This judgment is therefore preferable so that the image forming apparatus 1 will not consume more power by switching to normal operation mode for nothing. Alternatively it may be preferred for the controller 104*a* to switch the power supply mode from sub-level power saving mode to top-level power saving mode or to another level of power saving mode.

If the output voltage of the human body sensor 2020 does not become greater than the voltage threshold V3 or the output frequency of the human body sensor 2020 does not become higher than the frequency threshold F3, within a predetermined period of time after it is judged that a user, who is in any of the first detecting areas 2050*b*, stretches his/her arm, i.e.; if the user shows no sign of operating the image forming apparatus 1 for a long time, then the controller 104*a* may judge that the user has already left the image forming apparatus 1 and switch the power supply mode from normal operation mode to top-level power saving mode or to another level of power saving mode.

In the embodiment as described above, the controller 104*a* allows the operation panel 102 to display a different initial operation screen depending on whether a user is about to operate the operation panel 102 or the automatic document feeder 103*a*. Alternatively, the controller 104*a* may allow the operation panel 102 to turn on the backlight and display an initial operation screen, only when detecting that a user enters any of the second detecting areas 2050*c* by moving his/her arm forward, without the need of judging whether the user is about to operate the operation panel 102 or the automatic document feeder 103*a*.

Furthermore, in this embodiment, the controller 104*a* judges whether or not a user enters any of the second detecting areas 2050*c* by his/her arm, by comparing the peak voltage of the output signal S3 to a voltage threshold or comparing the frequency of the output signal S3 to a frequency threshold. Alternatively, the controller 104*a* may firstly compare the peak voltage of the output signal S3 to a voltage threshold; only if it is greater than the voltage threshold, secondly compares the frequency of the output signal S3 to a frequency threshold; then only if it is higher than the frequency threshold, finally judge that a user enters any of the second detecting areas 2050*c* by his/her hand.

Figure 18:
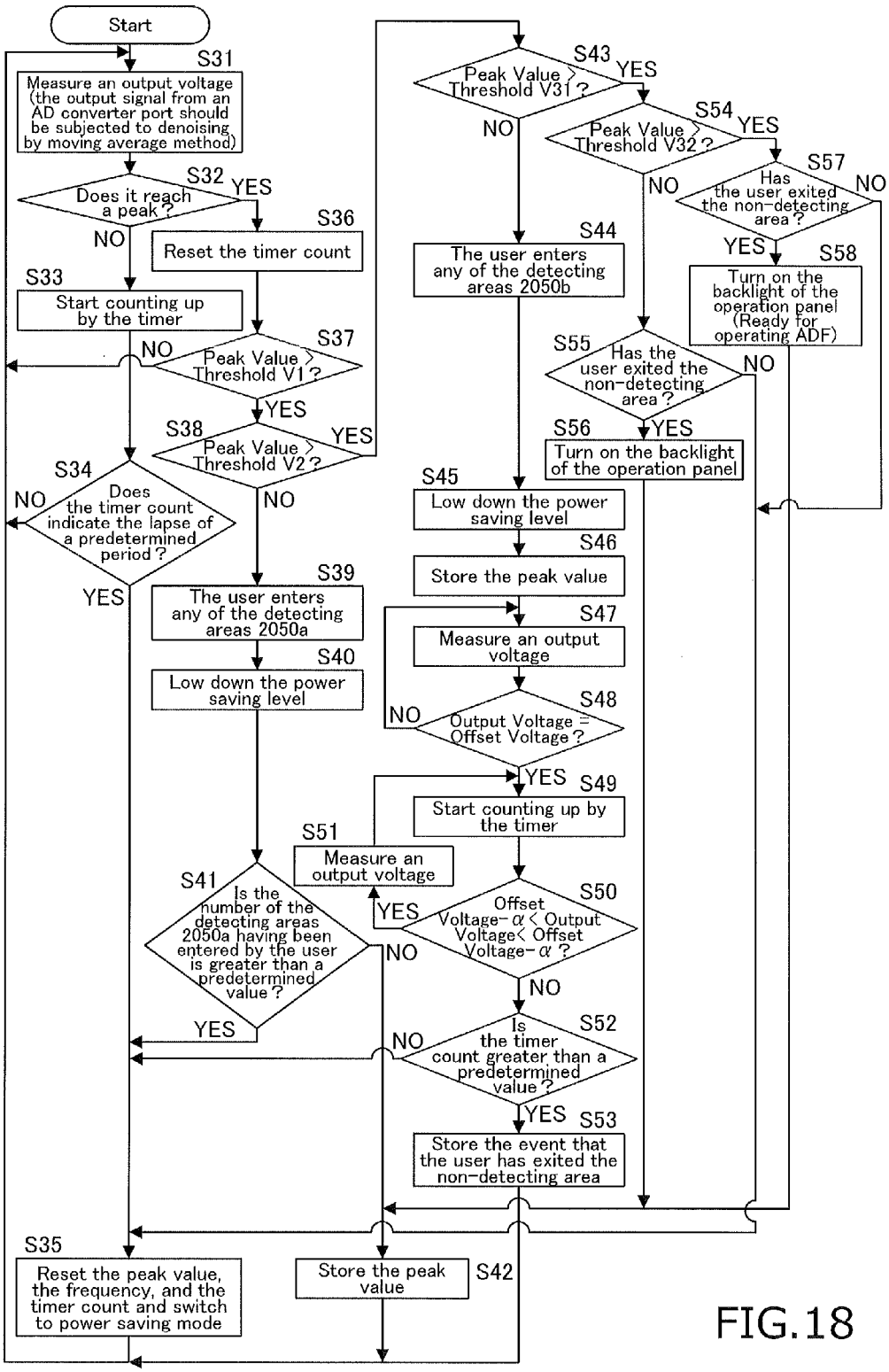
FIG. 18 is a flowchart representing the user approach and action detection operation of the image forming apparatus.

FIG. 18 is a flowchart representing the approach and action detection operation to be performed by the image forming apparatus 1 when a user enters such a detecting area as illustrated in FIG. 16 and moves toward the image forming apparatus 1. The operation is executed by the CPU of the controller 104*a* in accordance with an operation program stored on a memory such as a ROM.

In Step S31 of FIG. 18, the output voltage of the human body sensor 2020 is measured. The output voltage is measured every five milliseconds, for example. Before the voltage measurement, the output signal from an AD converter port should be subjected to denoising by moving average method.

Then in Step S32, it is judged whether or not the output voltage reaches a peak. If the output voltage does not reach a peak (NO in Step S32), the timer starts counting up in Step S33. Then it is judged in Step S34 whether or not the timer count indicates the lapse of a predetermined period of time.

If the timer count does not indicate the lapse of a predetermined period of time (NO in Step S34), the routine returns to Step S31. If the timer count indicates the lapse of a predetermined period of time (YES in Step S34), the routine proceeds to Step S35 in which the peak value, the frequency, and the timer count are reset to raise the power saving level to the top. Then the routine returns to Step S31.

If the output voltage reaches a peak (YES in Step S32), the timer count is reset in Step S36. In Step S37, it is confirmed whether or not a user enters any of the first detecting areas 2050*a* in the outer row, by judging whether or not peak voltage is greater than the voltage threshold V1.

If the peak voltage is not greater than the voltage threshold V1 (NO in Step S37), the routine returns to Step S31 because it is confirmed that a user does not enter the first detecting area 2050*a* in the outer row. If the peak voltage is greater than the voltage threshold V1 (YES in Step S37), then it is confirmed in Step S38 whether or not the user enters any of the first detecting areas 2050*b* in the second outer row, by judging whether or not the peak value is greater than the voltage threshold V2.

If the peak voltage is not greater than the voltage threshold V2 (NO in Step S38), it is confirmed that the user enters any of the first detecting areas 2050*a* in the outer row in Step S39. In Step S40, the power saving level is lowered down to an operation mode for restoring power supply to the image processor block 100, for example. Then in Step S41, it is judged whether or not the user moves through the first detecting areas 2050*a* laterally to the image forming apparatus 1. This judgment operation will be further described below.

The user, who moves laterally to the image forming apparatus 1, sometimes may give a turn to move toward the image forming apparatus 1 with an intention to operate the image forming apparatus 1. For example, if five first detecting areas 2050*a* are arranged side by side at a certain interval in the outer row, the user may give a turn at the third detecting area 2050*a* to move toward the image forming apparatus 1. Upon obtaining four or more output signals S1, it will be confirmed that the user moves through the five first detecting areas 2050*a* in the outer row laterally to the image forming apparatus 1.

That means, it will be judged whether or not the number of the first detecting areas 2050*a* having been entered by the user is greater than a round-off quotient obtained by the following inequality: the number of the first detecting areas 2050*a*÷2, which corresponds to the judgment operation in Step S41.

If the user moves through the first detecting areas 2050*a* laterally to the image forming apparatus 1 (YES in Step S41), the routine proceeds to Step S35 in which the peak value, the frequency, and the timer count are reset to raise the power saving level to the top again. If the user does not move through the first detecting areas 2050*a* laterally to the image forming apparatus 1 (NO in Step S41), the peak value is stored in Step S42. Then the routine returns to Step S31.

Back to Step S38, if the peak voltage is greater than the voltage threshold V2 (YES in Step S38), then it is confirmed in Step S43 whether or not the user enters any of the second detecting areas 2050*c* by stretching out his/her arm toward the operation panel 102, by judging whether or not the peak voltage is greater than the voltage threshold V31.

If the peak voltage is not greater than the voltage threshold V31 (NO in Step S43), it is confirmed that the user enters any of the second detecting areas 2050*b* in Step S44. In Step S45, the power saving level is further lowered down to an operation mode for restoring power supply to the engine controller block 101 and the operation panel 102 of the image forming apparatus 1. At this point, the operation panel 102 does not turn on the backlight yet.

Subsequently, the peak value is stored in Step S46, and the output voltage of the human body sensor 2020 is measured in Step S47. Then it is judged in Step S48 whether or not the output voltage reaches the offset voltage. If the output voltage does not reach the offset voltage (NO in Step S48), the routine returns to Step S47 to repeat the voltage measurement of Step S47 and the judgment of Step S48 until the output voltage reaches the offset value. If the output voltage reaches the offset value (YES in Step S48), the timer starts counting up in Step S49.

Then it is judged in Step S50 whether or not the output voltage satisfies the following inequality: (offset voltage−α)<output voltage<(offset voltage+α). If the output voltage satisfies that inequality (YES in Step S50), the output voltage of the human body sensor 2020 is measured in Step S51. Then the routine returns to Step S49 to repeat the timer counting up of Step S49 and the judgment of Step S50 until the output voltage does not satisfy the following inequality: (offset voltage−α)<output voltage<(offset voltage+α).

If the output voltage does not satisfy that inequality (NO in Step S50), then it is judged in Step S50 whether or not the timer count representing the non-detecting time of the human body sensor 2020 is equal to or smaller than a predetermined value. If the timer count is greater than a predetermined value (NO in Step S52), then it is confirmed that the user is close the image forming apparatus 1 with no intention to operate, and the routine proceeds to Step S35 in which the peak value, the frequency, and the timer count are reset to raise the power saving level to the top. Then the routine returns to Step S31.

If the timer count is equal to or smaller than a predetermined value (YES in Step S52), the event that the user has exited the non-detecting area 2050*b* is stored in Step S53. Then the routine returns to Step S31.

Back to Step S43, if the peak voltage is greater than the voltage threshold V31 (YES in Step S43), then it is confirmed in Step S54 whether or not the user enters any of the second detecting areas 2050*c* by stretching out his/her arm to the automatic document feeder 103*a*, by judging whether or not the peak voltage is greater than the voltage threshold V32.

If the peak voltage is not greater than the voltage threshold V32 (NO in Step S54), then it is judged in Step S55 whether or not the user has exited the non-detecting area 2050*d*. If the user has exited the non-detecting area 2050*d* (YES in Step S55), then it is confirmed that the user enters any of the second detecting areas 2050*c* by stretching out his/her arm toward the operation panel 102, and the routine proceeds to Step S56 in which the operation panel 102 turns on the backlight and displays an initial operation screen. Then the routine proceeds to Step S42. In Step S55, if the user has not exited the non-detecting area 2050*d* yet (NO in Step S55), the routine proceeds to Step S35.

Back to Step S54, if the peak voltage is greater than the voltage threshold V32 (YES in Step S54), then it is judged in Step S57 whether or not the user has exited the non-detecting area 2050*d*. If the user has exited the non-detecting area 2050*d* (YES in Step S57), then it is confirmed that the user enters any of the second detecting areas 2050*c* by stretching out his/her arm toward the automatic document feeder 103*a*, and the routine proceeds to Step S38 in which the operation panel 102 turns on the backlight and displays an operation screen for operating the automatic document feeder 103*a*. Then the routine proceeds to Step S42. In Step S57, if the user has not exited the non-detecting area 2050*d* yet (NO in Step S57), the routine proceeds to Step S35.

As described above, the controller 104*a* changes the power supply mode accordingly when detecting that the user, who is close to the image forming apparatus 1, enters any of the second detecting area 2050*c* by stretching out his/her arm forward.

In FIG. 18, the user approach and action detection operation is performed by comparing the output voltage of the human body sensor 2020 to voltage thresholds, for example. Alternatively, it may be performed by comparing the output frequency of the human body sensor 2020 to frequency thresholds.

Figure 19:
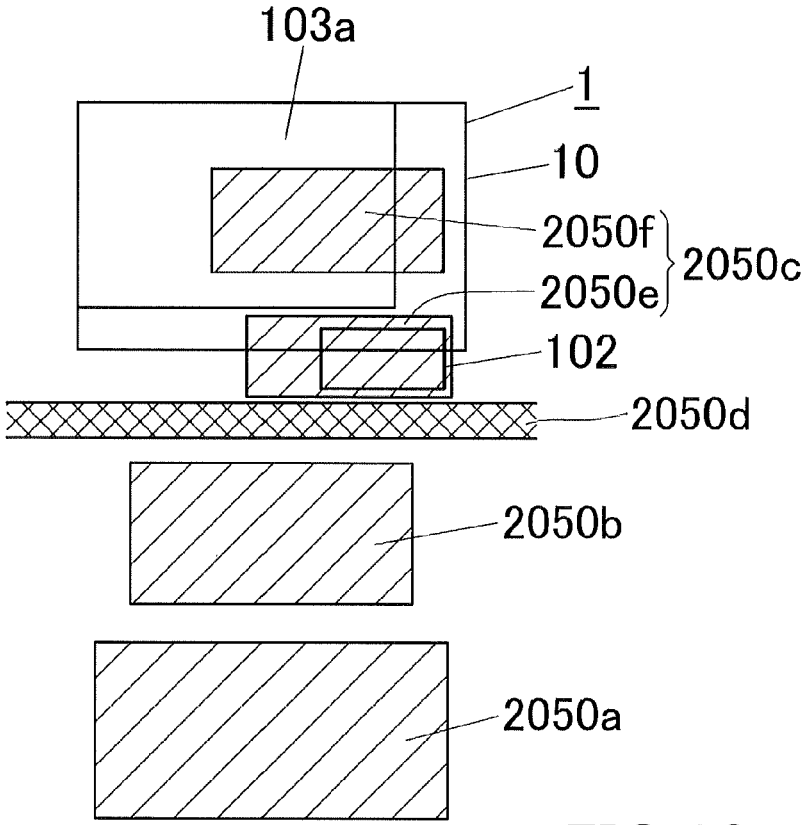
FIG. 19, which relates to a third embodiment of the present invention, is a schematic plan view illustrating the positions of the image forming apparatus and the detecting area.

FIG. 19 relates to a third embodiment of the present invention. In the third embodiment, some structure members correspond to the respective identically numbered structure members of the first and second embodiment and these will be omitted in the following description.

In this embodiment, the human body detecting device 2000 has a different configuration of the fly-eye lens 2030 whose single lenses 2040 form multiple second detecting areas 2050*c* in a different manner; the human body detecting device 2000 is installed at a reasonable position for the configuration.

Specifically, there are a detecting area 2050*e* for the operation panel 102 which serves to detect if a user stretches out his/her arm to the operation panel 102; and a detecting area 2050*f* for the automatic document feeder 103*a* which serves to detect if a user stretches out his/her arm to the automatic document feeder 103*a*, above and near the top surface of the image forming apparatus 1. The image forming apparatus 1 is closer to the detecting area 2050*e* than to the non-detecting area 2050*d* and closer to the detecting area 2050*f* than to the detecting area 2050*e*.

In this embodiment, when a user stretches out his/her arm to the operation panel 102, this action will be detected by the detecting area 2050*e* for the operation panel 102, the human body sensor 2020 then will produce the output signal S3 having a waveform with one peak. When a user stretches out his/her arm to the automatic document feeder 103*a*, this action will be detected both by the detecting area 2050*e* for the operation panel 102 and the detecting area 2050*f* for the automatic document feeder 103*a*, the human body sensor 2020 then will produce the output signal S3 having a waveform with two peaks.

The controller 104*a* of the power controller block 104 calculates the number of the peaks in the waveform of the output signal S3. If it is one, it is confirmed that the user is about to operate the operation screen 102; if it is two or more, it is confirmed that the user is about to operate the automatic document feeder 103*a*. In any of the cases, the controller 104*a* switches the power supply mode from power saving mode to normal operation mode and allows the operation panel 102 to display a different operation screen depending on the result of the judgment.

Figure 20A:
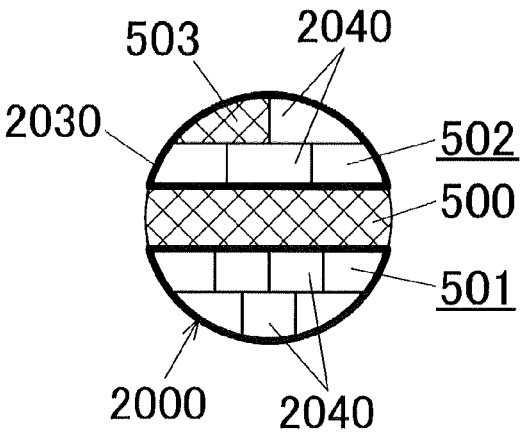
FIGS. 20A and 20B are a schematic plan view illustrating a lens of the human body detecting device.
Figure 20B:
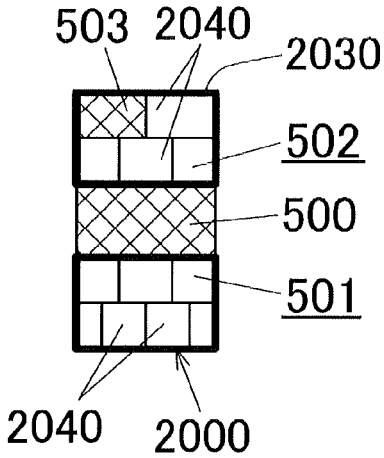

FIG. 20 illustrates another example of the fly-eye lens 2030, which corresponds to FIG. 13.

In this example, there is a block portion 503 over a particular one of the single lenses 2040 of the second single-lens group 502 for forming the second detecting areas 2050*c*, in addition to the block portion 500 that is sandwiched in between the first and second single-lens group 501 and 502. While the block portion 500 forms the non-detecting area 2050*d* between the row of the first detecting areas 2050*b* and the row of the second detecting areas 2050*c*, the block portion 503 forms a non-detecting area not serving to detect infrared energy, around at least either one of the detecting area 2050*e* for the operation panel 102 and the detecting area 2050*f* for the automatic document feeder 103*a*.

The human body detecting device 2020, having such a configuration as described above, is allowed to form the detecting area 2050*e* for the operation panel 102, the detecting area 2050*f* for the automatic document feeder 103*a*, and the non-detecting area 2050*d* between the detecting areas 2050*e* and 2050*f*, which noticeably improves the accuracy in detecting if a user stretches out his/her arms to the operation panel 102 or the automatic document feeder 103*a*.

The present invention, whose one embodiment has been described in detail herein, can solve the unsolved problems by its following modes:

[1] An image forming apparatus comprising:

a piezoelectric human body sensor being configured to produce a variable output signal having a voltage waveform with a positive or negative peak based on a certain level of offset voltage, depending on the amount of infrared energy emitted by a person;

a human body detecting device having the human body sensor and a lens being positioned to cover the human body sensor, the lens being configured to form a detecting area serving for detecting if the person enters, the detecting area extending outside of the human body detecting device itself in front of the image forming apparatus;

a peak detector being configured to detect a peak of an output signal produced by the human body sensor when the person enters the detecting area;

an offset voltage judgment portion being configured to judge if the output signal falls to the offset voltage after the peak detected by the peak detector;

a moving direction judgment portion being configured to judge the direction in which the person moves in the detecting area, on the basis of the peak value of the peak detected by the peak detector and the judgment result obtained by the offset voltage judgment portion; and a mode controller being capable of switching a power supply mode for controlling power supply to each portion of the image forming apparatus, between a first operation mode and a second operation mode requiring less power than the first operation mode, the mode controller being configured to switch the power supply mode to the first operation mode if the power supply mode is found to be the second operation mode while the moving direction judgment portion judges that the person moves toward the image forming apparatus.

[2] The image forming apparatus as recited in the foregoing item [1], wherein:

the peak detector further being configured to detect a first and second peak at some interval in this order; and the moving direction judgment portion being configured to judge that the person moves toward the image forming apparatus, if the peak value of the second peak is greater than that of the first peak while the offset voltage judgment portion judges that the output signal does not fall to the offset voltage between the first and second peaks.

[3] The image forming apparatus as recited in the foregoing item [1] or [2], wherein:

the peak detector is configured to detect a first and second peak at some interval in this order;

the moving direction judgment portion is configured to judge that the person moves away from the image forming apparatus, if the second peak has a lower peak value than that of the first peak while the offset voltage judgment portion judges that the output signal does not fall to the offset voltage between the first and second peaks; and the mode controller is configured to switch the power supply mode to the second operation mode, if the power supply mode is found to be the first operation mode while the moving direction judgment portion judges that the person moves away from the image forming apparatus.

[4] The image forming apparatus as recited in any one of the foregoing items [1] to [3], wherein:

the moving direction judgment portion is configured to judge that the person moves in the detecting area laterally to the image forming apparatus, if the offset voltage judgment portion judges that the output signal falls to the offset voltage after the peak detected by the peak detector; and the mode controller is configured to switch the power supply mode to the second operation mode, if the power supply mode is found to be the first operation mode while the moving direction judgment portion judges that the person moves in the detecting area laterally to the image forming apparatus.

[5] The image forming apparatus as recited in the foregoing item [2], wherein:

the mode controller is capable of switching the power supply mode between the following three operation modes: the first operation mode; the second operation mode; and a third operation mode requiring less power than the first operation mode but more power than the second operation mode; and the mode controller is configured to switch the power supply mode from the second operation mode to the third operation mode then from the third operation mode to the first operation mode, in a step-by-step manner, if the period between the first and second peak is greater than a predetermined value.

[6] The image forming apparatus as recited in the foregoing item [2], wherein:

the mode controller is capable of switching the power supply mode between the following three operation modes: the first operation mode, the second operation mode, and a third operation mode requiring less power than the first operation mode but more power than the second operation mode; and the mode controller is configured to:

switch the power supply mode from the second operation mode to the first operation mode in a direct manner, if the moving direction judgment portion judges that the person moves toward the image forming apparatus, within a certain period of time after judging that the person moves in the detecting area laterally to the image forming apparatus because the offset judgment portion judges that the output signal falls to the offset voltage after the peak detected by the peak detector; and switch the power supply mode from the second operation mode to the third operation mode then from the third operation mode to the first operation mode, in a step-by-step manner, if the moving direction judgment portion judges that the person moves directly toward the image forming apparatus even without moving in the detecting area laterally to the image forming apparatus.

[7] An image forming apparatus comprising:

a piezoelectric human body sensor being configured to produce a variable output signal depending on the amount of infrared energy emitted by a user;

a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas;

a non-detecting time detector being configured to detect a non-detecting time if the human body sensor produces a low level of output signal corresponding to the presence of the non-detecting area after an output signal corresponding to the presence of the first detecting area;

an entry judgment portion being configured to judge if the user, who is in the first detecting area, enters the second detecting area by moving a part of the user's body forward over the non-detecting area, on the basis of either one of both of the magnitude and the frequency of an output signal produced after the non-detecting time; and a power controller being capable of switching a power supply mode for controlling power supply to each portion of the image forming apparatus, between a first operation mode and a second operation mode requiring less power than the first operation mode, the power controller being configured to switch the power supply mode to the first operation mode, if the power supply mode is found to be the second operation mode while the entry judgment portion judges that the user enters the second detecting area by moving a part of the user's body.

[8] The image forming apparatus as recited in the foregoing item [7], further comprising an operation panel being installed on the top edge of the front side of the main body of the image forming apparatus or at a position near the top edge thereof, wherein:

the first detecting area serves to detect if the user moves toward the main body of the image forming apparatus with an intention to operate the image forming apparatus; and the second detecting area serves to detect if the user moves either one or both of the user's hand and arm toward and over the main body of the image forming apparatus including the operation panel.

[9] The image forming apparatus as recited in the foregoing item [7] or [8], wherein the entry judgment portion is configured to judge that the user enters the second detecting area by moving a part of the user's body and the power controller is configured to switch the power supply mode from the second operation mode to the first operation mode, if the output signal has a peak value greater than a first voltage threshold set in advance, after the non-detecting time.

[10] The image forming apparatus as recited in the foregoing item [9], wherein the power controller is configured to switch the power supply mode from the second operation mode to the first operation mode, if the output signal has a peak value greater than the first voltage threshold within a certain period of time after the entry judgment portion judges that the user enters the first detecting area.

[11] The image forming apparatus as recited in the foregoing item [9] or [10], wherein the power controller is configured to switch the power supply mode from the first operation mode to the second operation mode or from the first operation mode to a third operation mode requiring less power than the second operation mode, if the output signal has a peak value equal to or lower than the first voltage threshold within a certain period of time after the power controller switches the power supply mode from the second operation mode to the first operation mode.

[12] The image forming apparatus as recited in the foregoing item [7] or [8], wherein the entry judgment portion is configured to judge that the user enters the second detecting area by moving a part of the user's body and the power controller is configured to switch the power supply mode from the second operation mode to the first operation mode, if the output signal has a frequency higher than a first frequency threshold set in advance, after the non-detecting time.

[13] The image forming apparatus as recited in the foregoing item [12], wherein the power controller is configured to switch the power supply mode from the second operation mode to the first operation mode, if the output signal has a frequency higher than the first frequency threshold within a certain period of time after the entry judgment portion judges that the person enters the first detecting area.

[14] The image forming apparatus as recited in the foregoing item [12] or [13], wherein the power controller is configured to switch the power supply mode from the first operation mode to the second operation mode or from the first operation mode to a third operation mode requiring less power than the second operation mode, if the output signal has a frequency equal to or lower than the first frequency threshold within a certain period of time after the power controller switches the power supply mode from the second operation mode to the first operation mode.

[15] The image forming apparatus as recited in any one of the foregoing items [9] to [11], further comprising an automatic document feeder on the top of the main body of the image forming apparatus, the automatic document feeder being positioned slightly more away from the user than the operation panel is, wherein:

the entry judgment portion is configured to: judge that the user is about to operate the operation panel, if the output signal has a peak value greater than the first voltage threshold but lower than a second voltage threshold that is set to be greater than the first voltage threshold, after the non-detecting time; and judge that the user is about to operate the automatic document feeder, if the output signal has a peak value greater than the second voltage threshold after the non-detecting time; and the power controller is configured to display an initial screen for normal operation on the operation panel, if the entry judgment portion judges that the user is about the operate the operation panel, and is configured to display a screen for operating the automatic document feeder on the operation panel if the entry judgment portion judges that the user is about to operate the automatic document feeder.

[16] The image forming apparatus as recited in any one of the foregoing items [12] to [14], further comprising an automatic document feeder on the top of the main body of the image forming apparatus, the automatic document feeder being positioned slightly more away from the user than the operation panel is, wherein:

the entry judgment portion is configured to: judge that the user is about to operate the operation panel, if the output signal has a frequency higher than the first frequency threshold but lower than a second frequency threshold that is set to be higher than the first frequency threshold, after the non-detecting time; and judge that the user is about to operate the automatic document feeder, if the output signal has a frequency higher than the second frequency threshold after the non-detecting time; and the power controller is configured to display an initial screen for normal operation on the operation panel, if the entry judgment portion judges that the user is about the operate the operation panel, and is configured to display a screen for operating the automatic document feeder on the operation panel if the entry judgment portion judges that the user is about to operate the automatic document feeder.

[17] The image forming apparatus as recited in any one of the foregoing items [8] to [14], further comprising an automatic document feeder on the top of the main body of the image forming apparatus, the automatic document feeder being positioned slightly more away from the user than the operation panel is, wherein:

the second detecting area includes: a detecting area for the operation panel, serving for detecting if the user is about to operate the image forming apparatus; and a detecting area for the automatic document feeder, serving for detecting if the user is about to operate the automatic document feeder;

the entry judgment portion is configured to: judge that the user is about to operate the operation panel, if the output signal has one peak after the non-detecting time; and judge that the user is about to operate the automatic document feeder, if the output signal has two or more peaks after the non-detecting time; and the power controller is configured to: display an initial screen for normal operation on the operation panel, if the entry judgment portion judges that the user is about the operate the operation panel; and display a screen for operating the automatic document feeder on the operation panel if the entry judgment portion judges that the user is about to operate the automatic document feeder.

[18] The image forming apparatus as recited in any one of the foregoing items [15] to [17], wherein the lens is configured to form a non-detecting area not serving for detecting infrared energy, the non-detecting area being positioned around either one or both of the detecting area for the operation panel and the detecting area for the automatic document feeder detecting area.

[19] The image forming apparatus as recited in any one of the foregoing items [8] to [18], wherein the non-detecting area being sandwiched in between the first and second detecting areas is positioned almost directly above the human body detection device and near the front edge of the operation panel.

[20] An power control method to be implemented by an image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control method comprising:

detecting a peak of an output signal produced by the human body sensor when the person enters the detecting area;

judging if the output signal falls to the offset voltage after the peak detected by the peak detector; and judging the direction in which the person moves in the detecting area, on the basis of the peak value of the peak and the result of the judgment on the output signal, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the person moves toward the image forming apparatus.

[21] A power control method to be implemented by an image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the person gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control method comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the user enters the second detecting area by moving a part of the user's body.

[22] The power control method as recited in the foregoing item [21], wherein:

an operation panel is installed on the top edge of the front side of the main body of the image forming apparatus or at a position near the top edge thereof; and the first detecting area serves for detecting if the user moves toward the main body of the image forming apparatus with an intention to operate the image forming apparatus and the second detecting area serves for detecting if the user moves either one or both of the user's hand and arm toward and over the main body of the image forming apparatus including the operation panel.

[23] A non-transitory computer-readable recording medium storing a power control program for making a computer of an image forming apparatus execute processing, the image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control program comprising:

detecting a peak of an output signal produced by the human body sensor when the person enters the detecting area;

judging if the output signal falls to the offset voltage after the peak; and judging the direction in which the person moves in the detecting area, on the basis of the peak value of the peak and the result of the judgment on the offset voltage, wherein a power supply mode for controlling power supply to each portion of the image forming apparatus can be switched between a first operation mode and a second operation mode requiring less power than the first operation mode, the power control program further comprising switching the power supply mode to the first operation mode if the power supply mode is found to be the second operation mode while it is judged that the person moves toward the image forming apparatus.

[24] A non-transitory computer-readable recording medium storing a power control program for making a computer of an image forming apparatus execute processing, the image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control program comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each of the image forming apparatus can be switched between a first operation mode and a second operation mode requiring less power than the first operation mode, the power control program further comprising switching the power supply mode to the first operation mode if the power supply mode is found to be the second operation mode while it is judged that the user enters the second detecting area by moving a part of the user's body.

[25] The non-transitory computer-readable recording medium storing the power control program as recited in the foregoing item [24], wherein:

an operation panel is installed on the top edge of the front side of the main body of the image forming apparatus or at a position near the top edge thereof; and the first detecting area serves for detecting if the user moves toward the main body of the image forming apparatus with an intention to operate the image forming apparatus and the second detecting area serves for detecting if the user moves either one or both of the user's hand and arm toward and over the main body of the image forming apparatus including the operation panel.

According to the aforementioned modes [1] and [7] of the invention, and [8], the human body sensor produces an output signal when a person enters a detecting area radially extending in front of the image forming apparatus, and the output signal has a different waveform due caused by a peak and possibly may fall to the offset voltage after the peak depending on the direction in which a person moves in the detecting area. When a person enters the detecting area, the direction in which the person moves in the detecting area is judged on the basis of the peak value of the peak and whether or not the output signal falls to the offset voltage after the peak. If the power supply mode is found to be the second operation mode requiring less power than the first operation mode after it is judged that the person moves toward the image forming apparatus, the power supply mode is switched to the first operation mode so that the person will not have to wait so long until the image forming apparatus becomes ready for operation. If the power supply mode is found to be the first operation mode already after that, the power supply mode is kept as the first operation mode.

According to the aforementioned modes [1] and [7] of the invention, and [8], the human body sensor produces an output signal when a person enters a detecting area radially extending in front of the image forming apparatus, and the output signal has a different waveform due caused by a peak and possibly may fall to the offset voltage after the peak depending on the direction in which a person moves in the detecting area. When a person enters the detecting area, the direction in which the person moves in the detecting area is judged on the basis of the peak value of the peak and whether or not the output signal falls to the offset voltage after the peak. If the power supply mode is found to be the second operation mode requiring less power than the first operation mode after it is judged that the person moves toward the image forming apparatus, the power supply mode is switched to the first operation mode so that the person will not have to wait so long until the image forming apparatus becomes ready for operation. If the power supply mode is found to be the first operation mode already after that, the power supply mode is kept as the first operation mode.

As described above, the image forming apparatus is allowed to change its power supply mode depending on the direction in which a person moves in one detecting area. In comparison to the conventional technique of detecting the direction in which a person moves through a plurality of detecting areas, the image forming apparatus achieves in decreasing user wait time before it becomes ready for operation, by judging in an early stage which power supply mode should be selected.

According to the aforementioned mode [2] of the invention, a first and second peak are detected at some interval in this order; it is judged that the person moves toward the image forming apparatus, if the peak value of the second peak is greater than that of the first peak while it is judged that the output signal does not fall to the offset voltage between the first and second peaks; and the power supply mode is switched to the first operation mode.

According to the aforementioned mode [3] of the invention, a first and second peak are detected at some interval in this order; it is judged that the person moves away from the image forming apparatus, if the peak value of the second peak is lower than that of the first peak while it is judged that the output signal does not fall to the offset voltage between the first and second peaks; and the power supply mode is switched to the second operation mode if the power supply mode is found to be the first operation mode while it is judged that the person moves away from the image forming apparatus. As described above, when a person, who is close to the image forming apparatus, gives a turn to move away from the image forming apparatus without operating, the image forming apparatus is allowed to change its power supply mode from the first operation mode to the second operation mode requiring less power than the first operation mode. This would contribute to reduction in power consumption.

According to the aforementioned mode [4] of the invention, it is judged that the person moves in the detecting area laterally to the image forming apparatus, if it is judged that the output signal falls to the offset voltage after the peak, then the power supply mode is switched from the first operation mode to the second operation mode in an early stage, which would contribute to reduction in power consumption.

According to the aforementioned mode [5] of the invention, it is judged that the person moves toward the image forming apparatus in a slow manner, if the period between the first and second peak is greater than a predetermined value, then the power supply mode is switched from the second operation mode to the third operation mode then from the third operation mode to the first operation mode, in a step-by-step manner. That is, the image forming apparatus is allowed to change its power supply mode depending on the moving speed of the person, which would contribute to reduction in power consumption.

According to the aforementioned mode [6] of the invention, the power supply mode is switched from the second operation mode to the first operation mode in a direct manner, if it is judged that the person moves toward the image forming apparatus within a predetermine period of time after it is judged that the person moves in the detecting area laterally to the image forming apparatus, i.e.; when the person, who moved in the detecting area laterally to the image forming apparatus, gives a turn to move toward the image forming apparatus; and the power supply mode is switched from the second operation mode to the third operation mode then from the third operation mode to the first operation mode, if it is judged that the person moves toward the image forming apparatus without moving in the detecting area laterally to the image forming apparatus, i.e.; when the person moves directly toward the image forming apparatus. That is, the image forming apparatus is allowed to change its power supply mode appropriately depending on the direction in which a person moves.

According to the aforementioned mode [7] of the invention, the human body sensor and the fly-eye lens form: a first detecting area serving for detecting if a user gets close to the image forming apparatus, the first detecting area being positioned outside of the image forming apparatus and near and in front of the image forming apparatus; a second detecting area serving for detecting if the user takes any action, the second detecting area being positioned outside of the image forming apparatus and very near and in front of the image forming apparatus; and a non-detecting area not serving for detecting infrared energy, the non-detecting area being sandwiched in between the first and second detecting areas. When the user enters the first detecting area, the human body sensor produces an output signal corresponding to the presence of the first detecting area; and then when the user enters the second detecting area by a part of his/her body, the human body sensor produces an output signal corresponding to the presence of the second detecting area, after a non-detecting time for which the human body sensor produces only a low level of output signal corresponding to the presence of the non-detecting area. It is judged whether or not the user enters the second detecting area by moving a part of his/her body forward over the non-detecting area, on the basis of either one or both of the magnitude and the frequency of an output signal to be produced after the non-detecting time. If the power supply mode of the image forming apparatus is found to be the second operation mode requiring less power than the first operation mode while it is judged that the user enters the second detecting area by a part of his/her body, the power supply mode is switched to the first operation mode. If the power supply mode is found to be the first operation mode already after that, the power supply mode is kept as the first operation mode.

When a user, who is in the first detecting area, stretches out his/her arm to operate the image forming apparatus, this action is detected by the second detecting area and it is judged that the user is about to operate the image forming apparatus. The power supply mode of the image forming apparatus is therefore switched to the second operation mode. In comparison to the conventional technique of switching the power supply mode to the first operation mode only if any button is pressed on the operation panel or an electrostatic sensor installed on the operation panel 102 detects that a user's hand is close to the operation panel, the image forming apparatus is allowed to decrease user wait time before it becomes ready for operation, by judging in an early stage which power supply mode should be selected.

Furthermore, the non-detecting area is sandwiched in between the first and second detecting areas. By the presence of the non-detecting area, the output signal shows a clear sign whether the user enters the first detecting area or enters the second detecting area by a part of his/her body; also by the presence of the non-detecting time, the output signal can be identified with a high degree of accuracy, as: whether or not the output signal corresponding to the presence of the first detecting area: and whether or not the output signal produced after the non-detecting time, corresponding to the presence of the second detecting area. That leads to achieving in judging with a high degree of accuracy whether or not a user has an intention to operate the image forming apparatus.

According to the aforementioned mode [8] of the invention, it is judged with a high degree of accuracy whether or not the user, who is in front of the image forming apparatus, stretches out either one or both of his/her arm and hand toward and over the main body of the image forming apparatus including the operation panel.

According to the aforementioned mode [9] of the invention, it is judged that the user enters the second detecting area by moving a part of his/her body and the power supply mode is switched from the second operation mode to the first operation mode, if the output signal has a peak value greater than the first voltage threshold after the non-detecting time. That is, the image forming apparatus is allowed to detect with accuracy if the user enters the second detecting area by a part of his/her body.

According to the aforementioned mode [10] of the invention, if the output signal has a peak value greater than the first voltage threshold within a predetermined period of time after it is judged that the user enters the first detecting area, the power supply mode is switched from the second operation mode to the first operation mode. That is, the image forming apparatus is allowed to avoid switching to the first operation mode for nothing, because the user, who is in the first detecting area, possibly may move away from the image forming apparatus without operating.

According to the aforementioned mode [11] of the invention, if the output signal has a peak value equal to or lower than the first voltage threshold within a certain period of time after the power supply mode is switched from the second operation mode to the first operation mode, it is confirmed that the user has no intention to operate the image forming apparatus any more. The power supply mode is therefore switched from the first operation mode to the second operation mode or from the first operation mode to a third operation mode requiring less power than the second operation mode, which would contribute to reduction in power consumption.

According to the aforementioned mode [12] of the invention, it is judged that the user enters the second detecting area by moving a part of his/her body and the power supply mode is switched from the second operation mode to the first operation mode, if the output signal has a frequency higher than the first frequency threshold after the non-detecting time. That is, the image forming apparatus is allowed to detect with accuracy if the user enters the second detecting area by a part of his/her body.

According to the aforementioned mode [13] of the invention, if the output signal has a frequency higher than the first frequency threshold within a predetermined period of time after it is judged that the user enters the first detecting area, the power supply mode is switched from the second operation mode to the first operation mode. That is, the image forming apparatus is allowed to avoid switching to the first operation mode for nothing, because the user, who is in the first detecting area, possibly may move away from the image forming apparatus without operating.

According to the aforementioned mode [14] of the invention, if the output signal has a frequency equal to or lower than the first frequency threshold within a certain period of time after the power supply mode is switched from the second operation mode to the first operation mode, it is confirmed that the user has no intention to operate the image forming apparatus any more. The power supply mode is therefore switched from the first operation mode to the second operation mode or from the first operation mode to a third operation mode requiring less power than the second operation mode, which would contribute to reduction in power consumption.

According to the aforementioned mode [15] of the invention, it is judged whether the user is about to operate the operation panel or the automatic document feeder, by comparing the peak value of an output signal produced after the non-detecting time to the first and second voltage thresholds. Depending on the result of the judgment, a different screen is displayed on the operation panel.

According to the aforementioned mode [16] of the invention, it is judged whether the user is about to operate the operation panel or the automatic document feeder, by comparing the frequency of an output signal produced after the non-detecting time to the first and second frequency thresholds. Depending on the result of the judgment, a different screen is displayed on the operation panel.

According to the aforementioned mode [17] of the invention, the second detecting area includes: a detecting area for the operation panel, serving for detecting if the user is about to operate the operation panel; and a detecting area for the automatic document feeder, serving for detecting if the user is about to operate the automatic document feeder. And it is judged whether the user is about to operate the operation panel or the automatic document feeder, by detecting the number of peaks an output signal produced after the non-detecting time. Depending on the result of the judgment, a different screen is displayed on the operation panel.

According to the aforementioned mode [18] of the invention, another non-detecting area not serving for detecting infrared energy is formed around either one or both of the detecting area for the operation panel and the detecting area for the automatic document feeder detecting area. That is, the image forming apparatus is allowed to detect with accuracy if the user enters the detecting area for the operation panel or the detecting area for the automatic document feeder by a part of his/her body.

According to the aforementioned mode [19] of the invention, the non-detecting area being sandwiched in between the first and second detecting areas is positioned almost directly above the human body detection device and near the front edge of the operation panel. That is, the image forming apparatus is allowed to detect with accuracy if the user, who is in the first detecting area, enters or leaves the second detecting area.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image forming apparatus comprising:

a piezoelectric human body sensor being configured to produce a variable output signal having a voltage waveform with a positive or negative peak based on a certain level of offset voltage, depending on the amount of infrared energy emitted by a person;

a human body detecting device having the human body sensor and a lens being positioned to cover the human body sensor, the lens being configured to form a detecting area serving for detecting if the person enters, the detecting area extending outside of the human body detecting device itself in front of the image forming apparatus;

a peak detector being configured to detect a peak of an output signal produced by the human body sensor when the person enters the detecting area;

an offset voltage judgment portion being configured to judge if the output signal falls to the offset voltage after the peak detected by the peak detector;

a moving direction judgment portion being configured to judge the direction in which the person moves in the detecting area, on the basis of the peak value of the peak detected by the peak detector and the judgment result obtained by the offset voltage judgment portion; and a mode controller being capable of switching a power supply mode for controlling power supply to each portion of the image forming apparatus, between a first operation mode and a second operation mode requiring less power than the first operation mode, the mode controller being configured to switch the power supply mode to the first operation mode if the power supply mode is found to be the second operation mode while the moving direction judgment portion judges that the person moves toward the image forming apparatus.

2. The image forming apparatus as recited in claim 1, wherein:

the peak detector further being configured to detect a first and second peak at some interval in this order; and the moving direction judgment portion being configured to judge that the person moves toward the image forming apparatus, if the peak value of the second peak is greater than that of the first peak while the offset voltage judgment portion judges that the output signal does not fall to the offset voltage between the first and second peaks.

3. The image forming apparatus as recited in claim 1, wherein:

the peak detector is configured to detect a first and second peak at some interval in this order;

the moving direction judgment portion is configured to judge that the person moves away from the image forming apparatus, if the second peak has a lower peak value than that of the first peak while the offset voltage judgment portion judges that the output signal does not fall to the offset voltage between the first and second peaks; and the mode controller is configured to switch the power supply mode to the second operation mode, if the power supply mode is found to be the first operation mode while the moving direction judgment portion judges that the person moves away from the image forming apparatus.

4. The image forming apparatus as recited in claim 1, wherein:

the moving direction judgment portion is configured to judge that the person moves in the detecting area laterally to the image forming apparatus, if the offset voltage judgment portion judges that the output signal falls to the offset voltage after the peak detected by the peak detector; and the mode controller is configured to switch the power supply mode to the second operation mode, if the power supply mode is found to be the first operation mode while the moving direction judgment portion judges that the person moves in the detecting area laterally to the image forming apparatus.

5. The image forming apparatus as recited in claim 2, wherein:

the mode controller is capable of switching the power supply mode between the following three operation modes: the first operation mode; the second operation mode; and a third operation mode requiring less power than the first operation mode but more power than the second operation mode; and the mode controller is configured to switch the power supply mode from the second operation mode to the third operation mode then from the third operation mode to the first operation mode, in a step-by-step manner, if the period between the first and second peak is greater than a predetermined value.

6. The image forming apparatus as recited in claim 2, wherein:

the mode controller is capable of switching the power supply mode between the following three operation modes: the first operation mode, the second operation mode, and a third operation mode requiring less power than the first operation mode but more power than the second operation mode; and the mode controller is configured to:

switch the power supply mode from the second operation mode to the first operation mode in a direct manner, if the moving direction judgment portion judges that the person moves toward the image forming apparatus, within a certain period of time after judging that the person moves in the detecting area laterally to the image forming apparatus because the offset judgment portion judges that the output signal falls to the offset voltage after the peak detected by the peak detector; and switch the power supply mode from the second operation mode to the third operation mode then from the third operation mode to the first operation mode, in a step-by-step manner, if the moving direction judgment portion judges that the person moves directly toward the image forming apparatus even without moving in the detecting area laterally to the image forming apparatus.

7. An image forming apparatus comprising:

a piezoelectric human body sensor being configured to produce a variable output signal depending on the amount of infrared energy emitted by a user;

a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas;

a non-detecting time detector being configured to detect a non-detecting time if the human body sensor produces a low level of output signal corresponding to the presence of the non-detecting area after an output signal corresponding to the presence of the first detecting area;

an entry judgment portion being configured to judge if the user, who is in the first detecting area, enters the second detecting area by moving a part of the user's body forward over the non-detecting area, on the basis of either one of both of the magnitude and the frequency of an output signal produced after the non-detecting time; and a power controller being capable of switching a power supply mode for controlling power supply to each portion of the image forming apparatus, between a first operation mode and a second operation mode requiring less power than the first operation mode, the power controller being configured to switch the power supply mode to the first operation mode, if the power supply mode is found to be the second operation mode while the entry judgment portion judges that the user enters the second detecting area by moving a part of the user's body.

8. The image forming apparatus as recited in claim 7, further comprising an operation panel being installed on the top edge of the front side of the main body of the image forming apparatus or at a position near the top edge thereof, wherein:

the first detecting area serves to detect if the user moves toward the main body of the image forming apparatus with an intention to operate the image forming apparatus; and the second detecting area serves to detect if the user moves either one or both of the user's hand and arm toward and over the main body of the image forming apparatus including the operation panel.

9. The image forming apparatus as recited in claim 8, further comprising an automatic document feeder on the top of the main body of the image forming apparatus, the automatic document feeder being positioned slightly more away from the user than the operation panel is, wherein:

the second detecting area includes: a detecting area for the operation panel, serving for detecting if the user is about to operate the image forming apparatus; and a detecting area for the automatic document feeder, serving for detecting if the user is about to operate the automatic document feeder;

the entry judgment portion is configured to: judge that the user is about to operate the operation panel, if the output signal has one peak after the non-detecting time; and judge that the user is about to operate the automatic document feeder, if the output signal has two or more peaks after the non-detecting time; and the power controller is configured to: display an initial screen for normal operation on the operation panel, if the entry judgment portion judges that the user is about the operate the operation panel; and display a screen for operating the automatic document feeder on the operation panel if the entry judgment portion judges that the user is about to operate the automatic document feeder.

10. The image forming apparatus as recited in claim 8, wherein the non-detecting area being sandwiched in between the first and second detecting areas is positioned almost directly above the human body detection device and near the front edge of the operation panel.

11. The image forming apparatus as recited in claim 7, wherein the entry judgment portion is configured to judge that the user enters the second detecting area by moving a part of the user's body and the power controller is configured to switch the power supply mode from the second operation mode to the first operation mode, if the output signal has a peak value greater than a first voltage threshold set in advance, after the non-detecting time.

12. The image forming apparatus as recited in claim 11, wherein the power controller is configured to switch the power supply mode from the second operation mode to the first operation mode, if the output signal has a peak value greater than the first voltage threshold within a certain period of time after the entry judgment portion judges that the user enters the first detecting area.

13. The image forming apparatus as recited in claim 11, wherein the power controller is configured to switch the power supply mode from the first operation mode to the second operation mode or from the first operation mode to a third operation mode requiring less power than the second operation mode, if the output signal has a peak value equal to or lower than the first voltage threshold within a certain period of time after the power controller switches the power supply mode from the second operation mode to the first operation mode.

14. The image forming apparatus as recited in claim 11, further comprising an automatic document feeder on the top of the main body of the image forming apparatus, the automatic document feeder being positioned slightly more away from the user than the operation panel is, wherein:

the entry judgment portion is configured to: judge that the user is about to operate the operation panel, if the output signal has a peak value greater than the first voltage threshold but lower than a second voltage threshold that is set to be greater than the first voltage threshold, after the non-detecting time; and judge that the user is about to operate the automatic document feeder, if the output signal has a peak value greater than the second voltage threshold after the non-detecting time; and the power controller is configured to display an initial screen for normal operation on the operation panel, if the entry judgment portion judges that the user is about the operate the operation panel, and is configured to display a screen for operating the automatic document feeder on the operation panel if the entry judgment portion judges that the user is about to operate the automatic document feeder.

15. The image forming apparatus as recited in claim 14, wherein the lens is configured to form a non-detecting area not serving for detecting infrared energy, the non-detecting area being positioned around either one or both of the detecting area for the operation panel and the detecting area for the automatic document feeder detecting area.

16. The image forming apparatus as recited in claim 7, wherein the entry judgment portion is configured to judge that the user enters the second detecting area by moving a part of the user's body and the power controller is configured to switch the power supply mode from the second operation mode to the first operation mode, if the output signal has a frequency higher than a first frequency threshold set in advance, after the non-detecting time.

17. The image forming apparatus as recited in claim 16, wherein the power controller is configured to switch the power supply mode from the second operation mode to the first operation mode, if the output signal has a frequency higher than the first frequency threshold within a certain period of time after the entry judgment portion judges that the person enters the first detecting area.

18. The image forming apparatus as recited in claim 16, wherein the power controller is configured to switch the power supply mode from the first operation mode to the second operation mode or from the first operation mode to a third operation mode requiring less power than the second operation mode, if the output signal has a frequency equal to or lower than the first frequency threshold within a certain period of time after the power controller switches the power supply mode from the second operation mode to the first operation mode.

19. The image forming apparatus as recited in claim 16, further comprising an automatic document feeder on the top of the main body of the image forming apparatus, the automatic document feeder being positioned slightly more away from the user than the operation panel is, wherein:

the entry judgment portion is configured to: judge that the user is about to operate the operation panel, if the output signal has a frequency higher than the first frequency threshold but lower than a second frequency threshold that is set to be higher than the first frequency threshold, after the non-detecting time; and judge that the user is about to operate the automatic document feeder, if the output signal has a frequency higher than the second frequency threshold after the non-detecting time; and the power controller is configured to display an initial screen for normal operation on the operation panel, if the entry judgment portion judges that the user is about the operate the operation panel, and is configured to display a screen for operating the automatic document feeder on the operation panel if the entry judgment portion judges that the user is about to operate the automatic document feeder.

20. A power control method to be implemented by an image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control method comprising:

detecting a peak of an output signal produced by the human body sensor when the person enters the detecting area;

judging if the output signal falls to the offset voltage after the peak detected by the peak detector; and judging the direction in which the person moves in the detecting area, on the basis of the peak value of the peak and the result of the judgment on the output signal, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the person moves toward the image forming apparatus.

21. A power control method to be implemented by an image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the person gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control method comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each portion of the image forming apparatus can be switched between a first operation mode and a second operation mode requiring less power than the first operation mode, the power control method further comprising switching the power supply mode to the first operation mode if the power supply mode is found to be the second operation mode while it is judged that the user enters the second detecting area by moving a part of the user's body.

22. The power control method as recited in claim 21, wherein:

an operation panel is installed on the top edge of the front side of the main body of the image forming apparatus or at a position near the top edge thereof; and the first detecting area serves for detecting if the user moves toward the main body of the image forming apparatus with an intention to operate the image forming apparatus and the second detecting area serves for detecting if the user moves either one or both of the user's hand and arm toward and over the main body of the image forming apparatus including the operation panel.

23. A non-transitory computer-readable recording medium storing a power control program for making a computer of an image forming apparatus execute processing, the image forming apparatus comprising:

a piezoelectric human body sensor being configured to produce a variable output signal having a voltage waveform of a positive or negative peak based on a certain level of offset voltage, depending on the amount of infrared energy emitted by a person; and a human body detecting device having the human body sensor and a lens being positioned to cover the human body sensor, the lens being configured to form a detecting area serving for detecting if the person enters, the detecting area extending outside of the human body detecting device itself in front of the image forming apparatus;

the power control program comprising:

detecting a peak of an output signal produced by the human body sensor when the person enters the detecting area;

judging if the output signal falls to the offset voltage after the peak; and judging the direction in which the person moves in the detecting area, on the basis of the peak value of the peak and the result of the judgment on the offset voltage, wherein a power supply mode for controlling power supply to each portion of the image forming apparatus can be switched between a first operation mode and a second operation mode requiring less power than the first operation mode, the power control program further comprising switching the power supply mode to the first operation mode if the power supply mode is found to be the second operation mode while it is judged that the person moves toward the image forming apparatus.

24. A non-transitory computer-readable recording medium storing a power control program for making a computer of an image forming apparatus execute processing, the image forming apparatus comprising:

a piezoelectric human body sensor being configured to produce a variable output signal depending on the amount of infrared energy emitted by a user; and a human body detecting device having the human body sensor and a fly-eye lens being positioned to cover the human body sensor, the fly-eye lens being configured to condense infrared light, the fly-eye lens consisting of a plurality of single lenses each being configured to form:

a first detecting area serving for detecting if the user gets close to the human body detecting device itself, the first detecting area being positioned outside of the human body detecting device itself and near and in front of the image forming apparatus;

a second detecting area serving for detecting if the user gets very close to the human body detecting device to take any action, the second detecting area being positioned outside of the human body detecting device itself and very near and in front of the image forming apparatus; and a non-detecting area not serving for detecting infrared energy, the non-detecting area being sandwiched in between the first and second detecting areas, the power control program comprising:

detecting a non-detecting time if the human body sensor produces a low level of output signal corresponding to the presence of the non-detecting area after an output signal corresponding to the presence of the first detecting area; and judging if the user, who is in the first detecting area, enters the second detecting area by moving a part of the user's body forward over the non-detecting area, on the basis of either one of both of the magnitude and the frequency of an output signal produced after the non-detecting time, wherein a power supply mode for controlling power supply to each of the image forming apparatus can be switched between a first operation mode and a second operation mode requiring less power than the first operation mode, the power control program further comprising switching the power supply mode to the first operation mode if the power supply mode is found to be the second operation mode while it is judged that the user enters the second detecting area by moving a part of the user's body.

25. The non-transitory computer-readable recording medium storing the power control program as recited in claim 24, wherein:

an operation panel is installed on the top edge of the front side of the main body of the image forming apparatus or at a position near the top edge thereof; and the first detecting area serves for detecting if the user moves toward the main body of the image forming apparatus with an intention to operate the image forming apparatus and the second detecting area serves for detecting if the user moves either one or both of the user's hand and arm toward and over the main body of the image forming apparatus including the operation panel.

* * * * *